US010441074B2

(12) United States Patent
Dahatonde et al.

(10) Patent No.: US 10,441,074 B2
(45) Date of Patent: Oct. 15, 2019

(54) SHELF FRAME ASSEMBLY SYSTEM

(71) Applicant: INTERMETRO INDUSTRIES CORPORATION, Wilkes-Barre, PA (US)

(72) Inventors: Harishchandra Dahatonde, Pune (IN); Sanjeeb Sinha, Pune (IN)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 117 days.

(21) Appl. No.: 15/526,118

(22) PCT Filed: Nov. 23, 2015

(86) PCT No.: PCT/US2015/062139
§ 371 (c)(1),
(2) Date: May 11, 2017

(87) PCT Pub. No.: WO2016/081934
PCT Pub. Date: May 26, 2016

(65) Prior Publication Data

US 2018/0289151 A1 Oct. 11, 2018

(30) Foreign Application Priority Data

Nov. 22, 2014 (IN) ..... 3707/MUM/2014

(51) Int. Cl.
*A47B 57/00* (2006.01)
*A47B 47/00* (2006.01)
(Continued)

(52) U.S. Cl.
CPC ..... *A47B 57/48* (2013.01); *A47B 47/0083* (2013.01); *A47B 47/027* (2013.01); *A47B 96/06* (2013.01); *A47B 96/1441* (2013.01)

(58) Field of Classification Search
CPC . A47B 47/027; A47B 47/021; A47B 47/0083; A47B 57/48; A47B 96/06; A47B 96/1433; A47B 57/40
See application file for complete search history.

(56) References Cited

U.S. PATENT DOCUMENTS 2,958,425 A * 11/1960 Best ..... A47B 47/027 211/182
2,962,170 A * 11/1960 Best ..... A47B 47/027 211/182

(Continued)

OTHER PUBLICATIONS

International Search Report and Written Opinion of the ISA, ISA/US, Alexandria, VA, dated May 26, 2016.

*Primary Examiner* — Kimberly S Wright
(74) *Attorney, Agent, or Firm* — Harness, Dickey & Pierce, P.L.C.

(57) ABSTRACT

A shelf frame assembly system includes a first vertical post that includes a plurality of openings, a side beam comprising a receiving bore, an end piece having a coupling portion and a receiving portion that includes a plurality of protrusions, and an end connector configured to be inserted into one of the plurality of openings. The end connector includes a plurality of recesses configured to receive the plurality of protrusions and a stop configured to make contact with at least one edge of the one of the plurality of openings. The receiving bore of the side beam is configured to receive the coupling portion of the end piece. The receiving portion of the side beam connector is configured to receive the end connector. Further, the plurality of protrusions are configured to resist a horizontal withdrawal of the side beam connector from the end connector.

14 Claims, 17 Drawing Sheets

(51) Int. Cl.

| | |
|---|---|
| ***A47B 57/48*** | (2006.01) |
| ***A47B 47/02*** | (2006.01) |
| ***A47B 96/06*** | (2006.01) |
| ***A47B 96/14*** | (2006.01) |

(56) References Cited

U.S. PATENT DOCUMENTS

| | | | | | |
|---|---|---|---|---|---|
| 3,778,175 | A | | 12/1973 | Zimmer | |
| 4,540,160 | A | | 9/1985 | Zanavich et al. | |
| 4,934,858 | A | * | 6/1990 | Beaulieu | F16B 12/40 403/174 |
| 5,048,995 | A | * | 9/1991 | Beaulieu | F16B 7/0473 403/264 |
| 5,680,737 | A | * | 10/1997 | Sheipline | E04B 1/24 403/169 |
| 5,695,081 | A | * | 12/1997 | Alkalay | A47B 47/04 108/147.12 |
| 5,931,450 | A | | 8/1999 | Yoder | |
| 6,036,034 | A | * | 3/2000 | Battaglia | A47B 57/404 211/187 |
| 6,364,138 | B1 | * | 4/2002 | Chen | A47B 57/26 108/147.13 |
| 6,935,623 | B2 | | 8/2005 | Cook et al. | |
| 7,191,908 | B2 | * | 3/2007 | De Rijk | A47B 57/32 211/187 |
| 8,118,181 | B2 | * | 2/2012 | Shinozaki | A47B 47/0083 108/147.13 |
| 8,627,966 | B2 | * | 1/2014 | Jarvis | A47B 55/00 211/187 |
| 8,651,300 | B2 | * | 2/2014 | Chen | A47B 57/265 108/107 |
| 2004/0200794 | A1 | * | 10/2004 | De Rijk | A47B 57/32 211/191 |
| 2010/0181272 | A1 | | 7/2010 | Cheng | |
| 2011/0056899 | A1 | * | 3/2011 | Shinozaki | A47B 47/0083 211/153 |
| 2013/0098857 | A1 | * | 4/2013 | Jarvis | A47B 55/00 211/182 |
| 2014/0217048 | A1 | * | 8/2014 | Wood | F16B 7/20 211/186 |
| 2014/0250795 | A1 | | 9/2014 | Wei | |

* cited by examiner

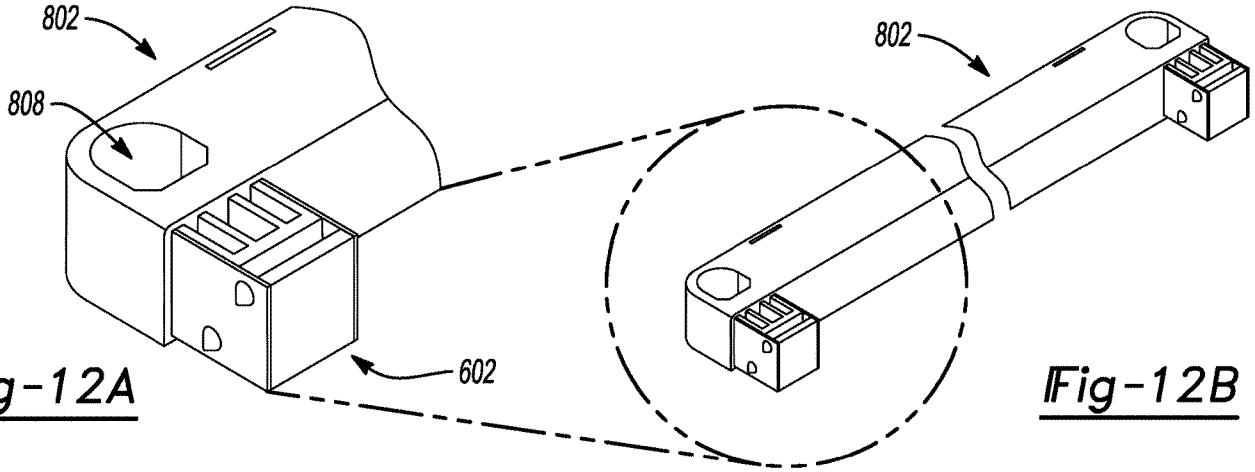
Fig-12A
Fig-12B
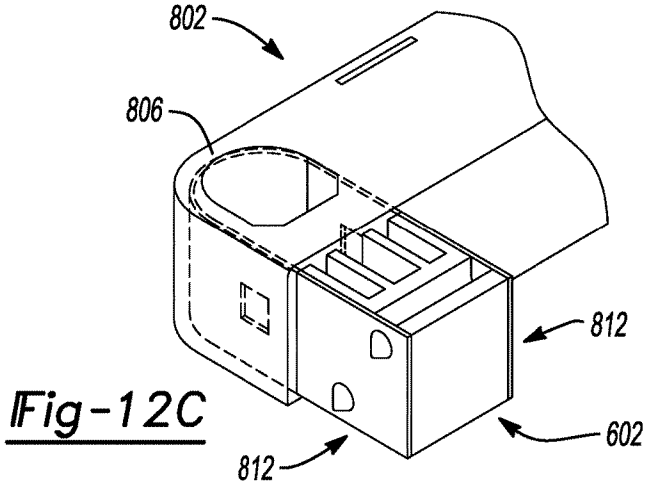
Fig-12C
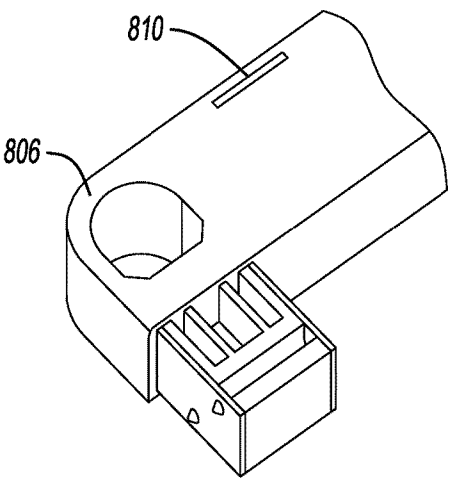
Fig-12D

SHELF FRAME ASSEMBLY SYSTEM

CROSS REFERENCE TO RELATED APPLICATIONS

This application is a 371 National Phase of International PCT Application PCT/US2015/062139, filed on Nov. 23, 2015, which claims priority to Indian Patent Application No. 3707/MUM/2014, filed on Nov. 22, 2014. The entire disclosures of the above applications are incorporated herein by reference.

FIELD

The present disclosure relates to a system and method for assembling a shelf-frame.

BACKGROUND

This section provides background information related to the present disclosure which is not necessarily prior art.

Known plastic shelf frames (see, e.g., http://www.metro.com/shelving/plastic-shelving) are assembled, using two molded end-beams, two length beams, four glue dam sleeves, four "shots" of hot melt glue, and four stainless steel screws. The glue dam sleeves are assembled to the two length beams. The beams are inserted into one or more sockets of the end beams. The frame assembly is inserted into an automated assembly fixture that holds the components, while injecting the joints with glue. A second fixture installs the four stainless steel screws.

The glue dams are intended to eliminate the gap caused by drafted surfaces of the one or more end beam sockets and create a clean interface between the two components. The glue dams are also intended to prevent the injected hot melt glue from seeping out of the joint, and the need for subsequent cleanup of glue flash. The glue dams also contain dovetail features that interface with the hardened glue to secure them in place. Though adequate, this shelf frame and assembly method can be improved. Accordingly, the present disclosure provides a permanent, corrosion resistant, cost effective shelf frame system and assembly method.

SUMMARY

This section provides a general summary of the disclosure, and is not a comprehensive disclosure of its full scope or all of its features.

Shelving frames may be assembled using a variety of quick connect construction features. For example, the quick connect construction features may include press-fitting shelving components, utilizing tool-less assembly, utilizing barbed components, and other suitable features. The shelf frames may be attached to vertical posts such that the frames and posts form a shelving unit. The shelving unit may be employed to store medical supplies, food supplies, and/or other shelving storable loads.

In some features, a shelf frame assembly system includes a first vertical post that includes a plurality of openings disposed on a surface of the vertical post, a side beam comprising a receiving bore disposed at a first end of the side beam, an end piece having a coupling portion and a receiving portion that includes a plurality of protrusions, and an end connector configured to be inserted into one of the plurality of openings.

The end connector includes a plurality of recesses configured to receive the plurality of protrusions and a stop configured to make contact with at least one edge of the one of the plurality of openings. The receiving bore of the side beam is configured to receive the coupling portion of the end piece. The receiving portion of the side beam connector is configured to receive the end connector. Further, the plurality of protrusions are configured to resist a horizontal withdrawal of the side beam connector from the end connector.

In other features, a shelf frame assembly system may include a first vertical post that includes a plurality of openings disposed on a surface of the vertical post, a side beam comprising a receiving bore disposed at a first end of the side beam and a recessed portion disposed on a lower portion of the side beam configured to engage an edge of one of the plurality of openings, and an end piece having one or more flexible portions, an upper portion, and a stop. Each of the flexible portions includes a barb.

The lower portion of the side beam engages the edge of the opening, creating a gap between an upper portion of the side beam and another edge of the opening. The end piece is configured to be pressed into the gap such that the upper portion makes contact with the other edge of the opening. Each of the flexible portions temporarily flex inward toward each other and return to an original position in response to the barb on each of the flexible portions snapping onto a respective side edge of the opening. Further, the stop prevents the end piece from being pressed into the opening beyond the stop.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected implementations and not all possible implementations, and are not intended to limit the scope of the present disclosure.

FIGS. 12A-12D illustrate another alternative shelf frame assembly system according to the principles of the present disclosure;

Corresponding reference numerals indicate corresponding parts throughout the several views of the drawings.

DETAILED DESCRIPTION

Example implementations will now be described more fully with reference to the accompanying drawings.

Figures 1A, 1B:
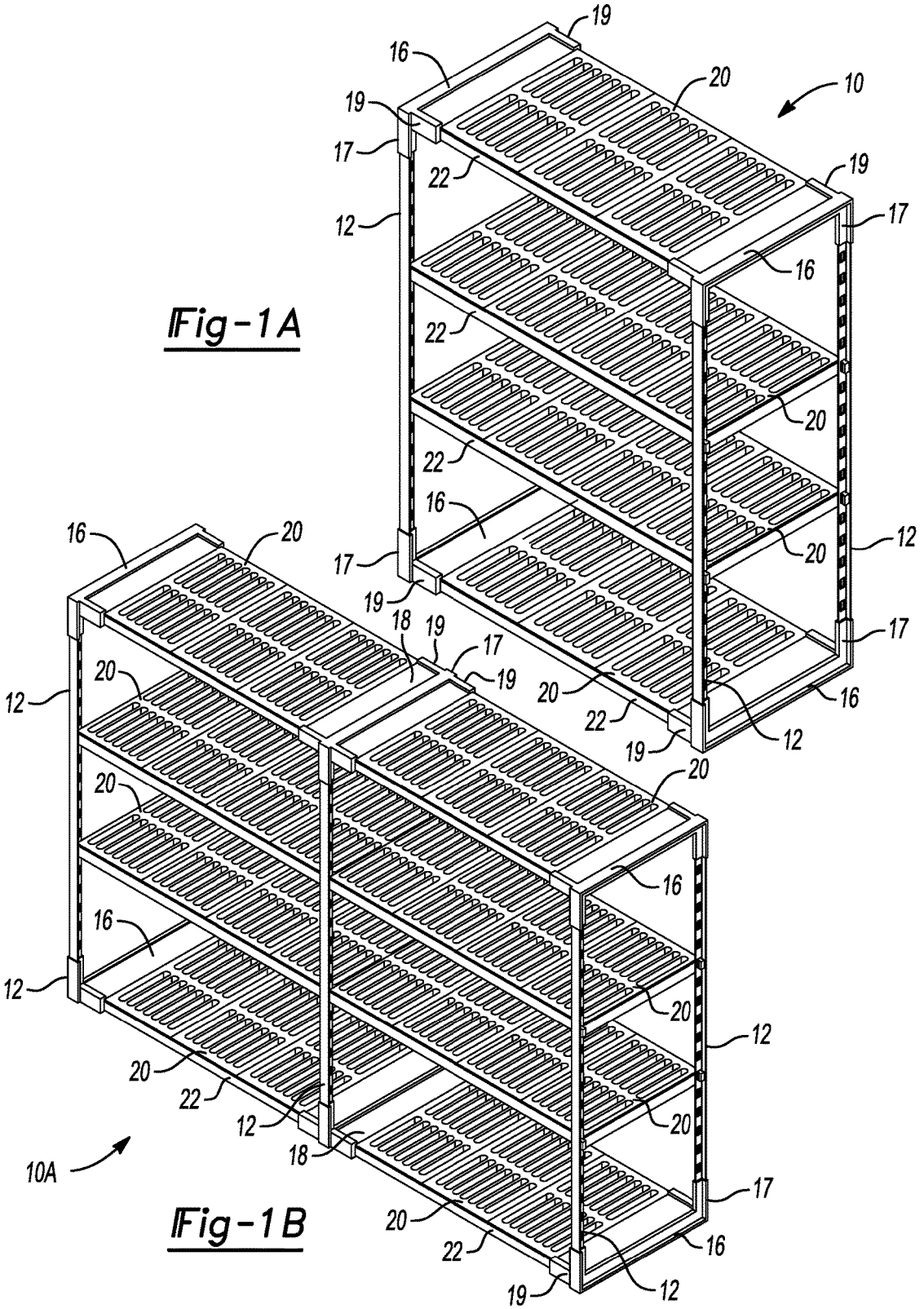
FIG. 1A is a perspective view of a shelving unit according to the principles of the present disclosure.
FIG. 1B is a perspective view of an alternative shelving unit according to the principles of the present disclosure.

With reference to FIG. 1A, a fully assembled shelving unit is shown generally at 10. The shelving unit 10 may be constructed using a variety of quick connect construction features, as will be described in detail below. In some implementations, the quick connect construction features may include press-fitting shelving components, utilizing tool-less assembly methods for the shelving unit 10, and other suitable features. The shelving unit 10 may be a standard shelving unit employed to store medical supplies, food supplies, and/or other shelving storable loads.

Figure 10A:
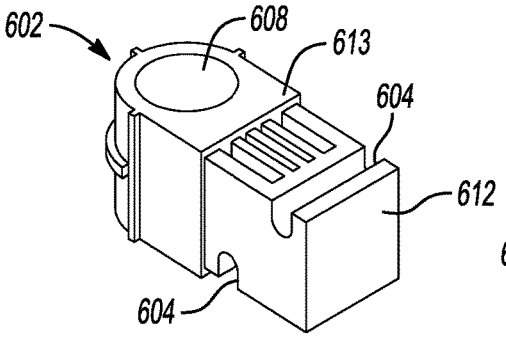
FIGS. 10A-10E illustrate another alternative shelf frame assembly system according to the principles of the present disclosure.
Figure 10B:
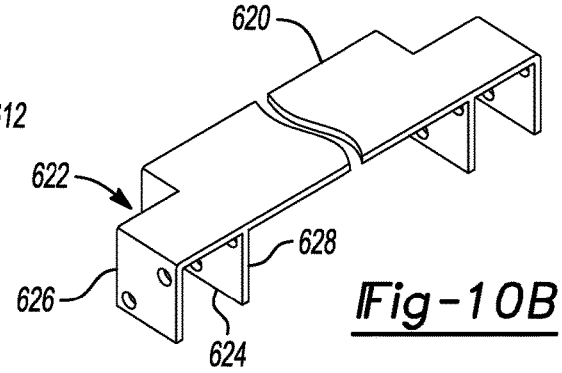
Figure 10C:
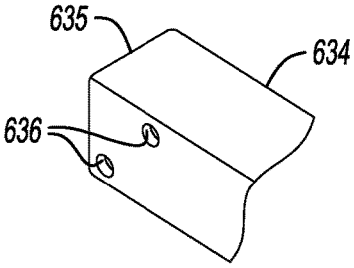
Figure 10D:
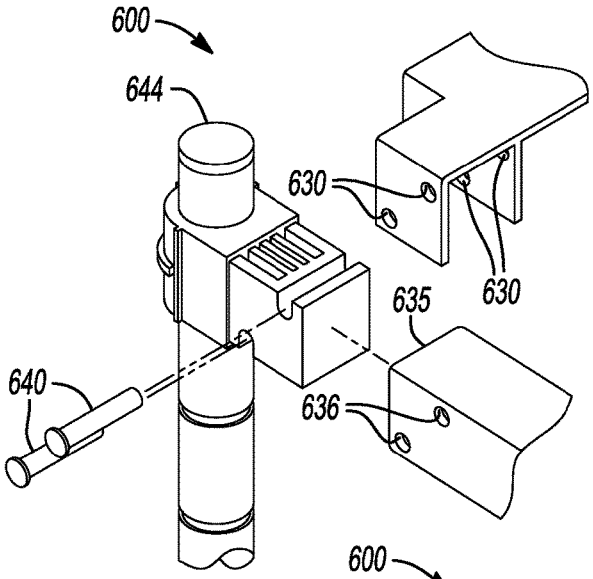
Figure 10E:
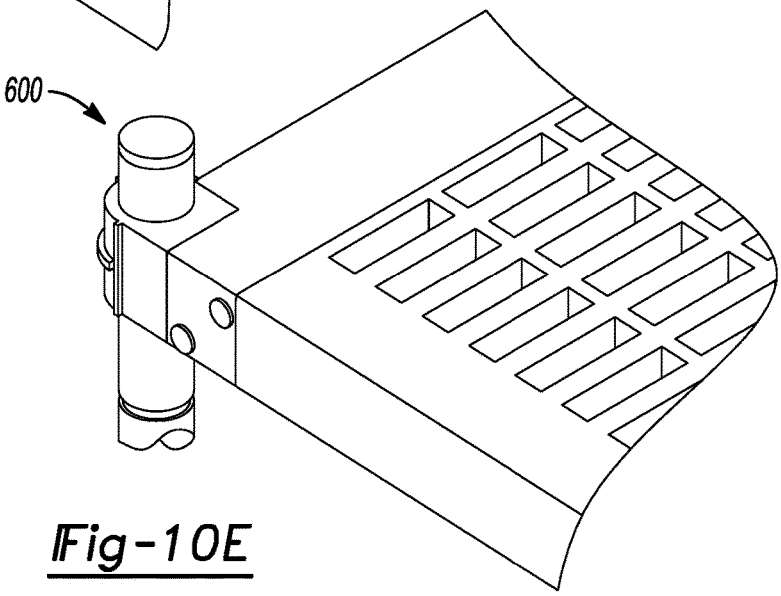

The shelving unit 10 includes a plurality of post connectors 16, a plurality of vertical posts 12, a plurality of side beams 22, and a plurality of grid mats 20. For example, the shelving unit 10 may include four post connectors 16, four vertical posts 12, and eight side beams 22. It is understood that any suitable number of post connectors 16, vertical posts 12, and side beams 22 is contemplated by the present disclosure. The post connectors 16 may be comprised of a polymer material or any other suitable material. In some implementations, the vertical posts 12 are T-Shaped posts as illustrated in FIGS. 1A-7C. In other implementations, the vertical posts may be a cylindrical vertical post as illustrated in at least FIG. 10D at 644.

Each of the post connectors 16 includes one or more post receiving portion 17 and one or more side beam receiving portion 19. Each post receiving portion 17 is configured to receive a first end of one of the vertical posts 12. For example, the post receiving portion 17 includes a receiving bore sized to receive the first end of the vertical post 12. In some implementations, the vertical post 12 may be press-fit into the post receiving portion 17.

As will be illustrated in detail below, the vertical post 12 may be received by and coupled to the post connectors 16 in a variety of manners. It is understood that while only one post receiving portion 17 receiving a first end of the vertical post 12 is described, a post connector 16 disposed on an opposite side of the vertical post 12 includes a post receiving portion 17 configured to receive a second end of the vertical post 12.

Further, each of the post connectors 16 may include another post receiving portion 17 configured to receive another vertical post 12. For example, the shelving unit 10 is depictured with four post connectors 16, eight post receiving portions 17, and four vertical posts 12.

Each of the side beam receiving portions 19 is configured to receive a first end of one of the side beams 22. For example, the side beam receiving portions 19 includes a receiving bore sized to receive the first end of side beam 22. In some implementations, the side beam 22 may be press-fit into the side beam receiving portions 19. As will be illustrated in detail below, the side beam 22 may be received by and coupled to the post connectors 16 in a variety of manners. It is understood that while only one side beam receiving portion 19 receiving a first end of the side beam 22 is described, a post connector 16 disposed on an opposite side of the side beam 22 includes a side beam receiving portion 19 configured to receive a second end of the side beam 22.

Further, each of the post connectors 16 may include another side beam receiving portion 19 configured to receive another side beam 22. For example, the shelving unit 10 is depictured with four post connectors 16, eight side beam receiving portion 19, and four found side beams 22 coupled to each of the post connectors 16.

Once the side beams 22 and vertical posts 12 are coupled to the post connectors 16, a plurality of grid mats 20 are press-fit onto the side beams 22 in order to form a shelf. In some implementations, the grid mats 20 may be glued, snapped, screwed, or attached to the side beams 22 in any suitable manner.

Figure 2:
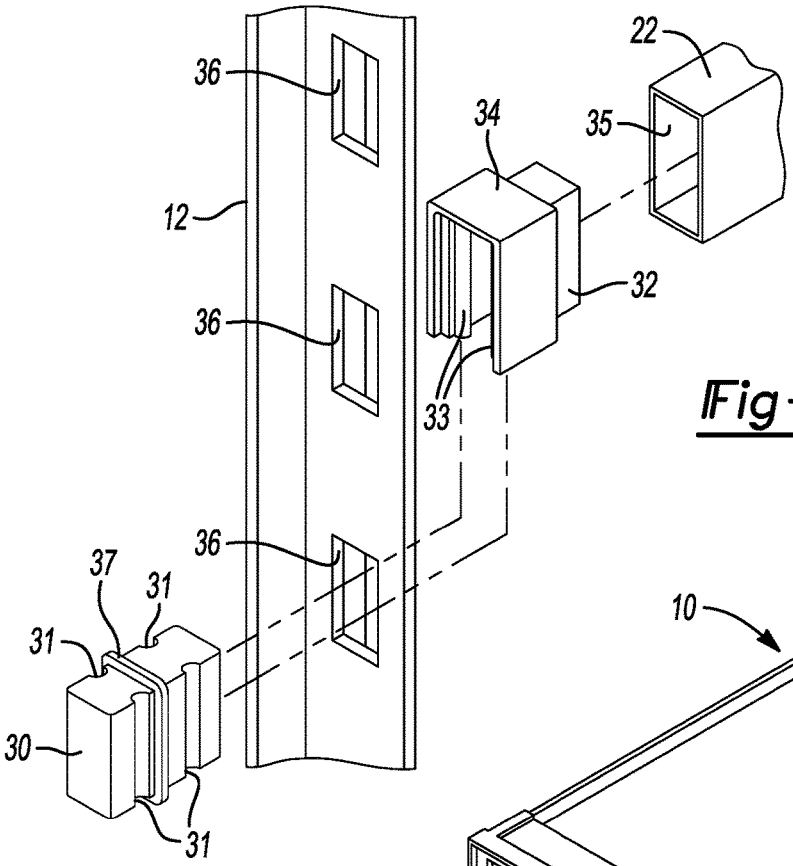
FIG. 2 is a perspective view of a portion of a shelf assembly system according to the principles of the present disclosure.

In some implementations, the shelving until 10 may include additional shelves. For example, the vertical posts 12 are configured to receive one or more side beams 22. As illustrated in FIG. 2, a shelf assembly system includes a vertical post 12, an end connector 30, a side beam end piece 34, and a side beam 22. The side beam 22 is configured to receive the side beam connector 34. For example, the side beam connector 34 includes a connection portion 32. The connection portion 32 is sized to be slightly smaller than a bore 35 in the side beam 22.

In some implementations, the connection portion 32 may be press-fit into the bore 35. In other implementations, the connection portion 32 may be friction held within the bore 35, glued into the bore 35, screwed into the bore 35, riveted into the bore 35, or engage the bore 35 in any suitable manner.

The side beam connector 34 further includes a plurality of protrusions 33 arranged on an inner surface of the side beam connector 34. The end connector 30 includes a first plurality of recessed portions 31 arranged on an outer surface of the end connector 30 on one side of a stop 37 and a second plurality of recessed portions 31 arranged on the outer surface of the end connector 30 on another side of the stop 37.

In other words, the first plurality of recessed portions 31 and the second plurality of recessed portions 31 are disposed on the end connector 30 on opposite sides of the stop 37. In one implementation, the side beam connector 34 includes a first protrusion 33 on a first interior surface of the side beam connector 34 and a second protrusion 33 on a second interior surface that is opposed to the first interior surface.

The end connector 30 includes a first recessed portion 31 on a first outer surface of the end connector 30 and a second recessed portion 31 on a second outer surface of the end connector 30. The first and second recessed portions 31 are disposed on a first side of the stop 37. Further, the first outer surface is opposed to the second outer surface.

The end connector 30 further includes a third recessed portion 31 on the first outer surface of the end connector 30 and a fourth recessed portion 31 on the second outer surface of the end connector 30. The third and fourth recessed portions 31 are disposed on a second side of the stop 37. The second side of the stop 37 is opposed to the first side of the stop 37.

The vertical post 12 includes a plurality of openings 36. The plurality of openings 36 allow an assembler of the shelve 10 to selectively determine a position of the additional shelves. The openings 36 are configured to receive the end connector 30. For example, the openings 36 may be rectangular shaped openings and the end connector 30 may have a similar rectangular shape that is slightly smaller than the openings 36. In other words, the end connector 30 is configured to fit within the openings 36.

The stop 37 is configured to be slightly larger than the opening 36, thereby preventing the end connector 30 from passing through the opening 36. The stop 37 may be located at or near a center of the end connector 30.

Figure 3A:
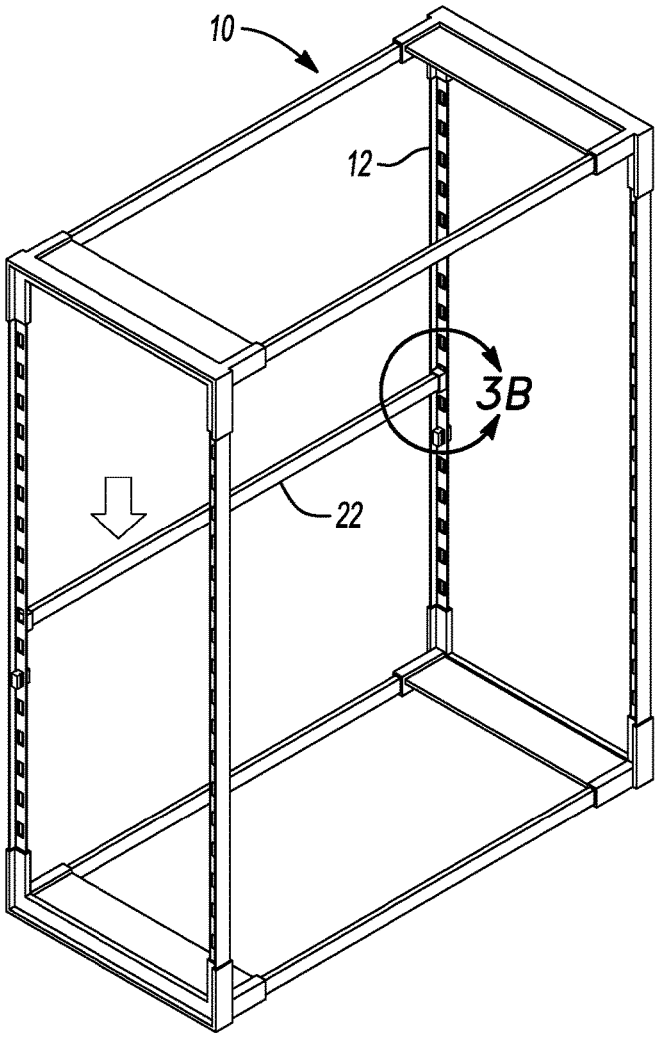
FIG. 3A is a perspective view of a partially assembled shelving unit of FIG. 1A.
Figure 3B:
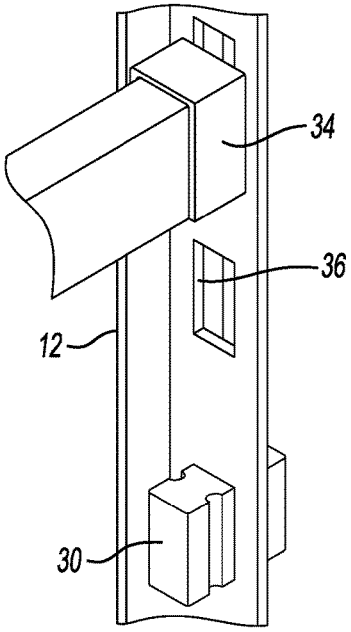
FIG. 3B is a perspective view of a partially assembled shelf assembly system of FIG. 2.
Figure 3C:
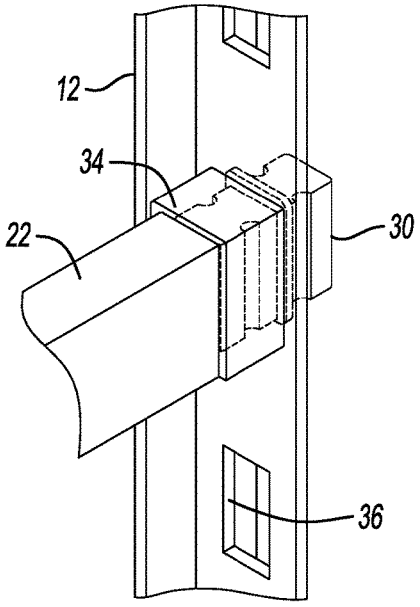
FIG. 3C is a perspective view of a fully assembled shelf assembly system of FIG. 2.

Each of the first plurality of recessed portions 31 is configured to receive one of the plurality of protrusions 33. Further, the side beam end piece 34 is configured to cover the end connector 30 when the plurality of recessed portions 31 receives a corresponding plurality of protrusions 33. As illustrated in FIGS. 3A-3C, the side beam 22 with the side beam end piece 34 received in the bore 35 is slid down unto the end connector 30, thereby securing the side beam 22 to the vertical post 12.

While only one end of a side beam 22 connecting to one vertical post 12 is described, it is understood that each end of each side beams 22 may be connected in the same manner as described above to each of the other vertical posts 12. With reference to FIG. 1A, grid mats 20 are press-fit, or attached in any suitable manner, to the side beams 22, thereby forming additional shelves in the shelving unit 10.

Figures 5A, 5B:
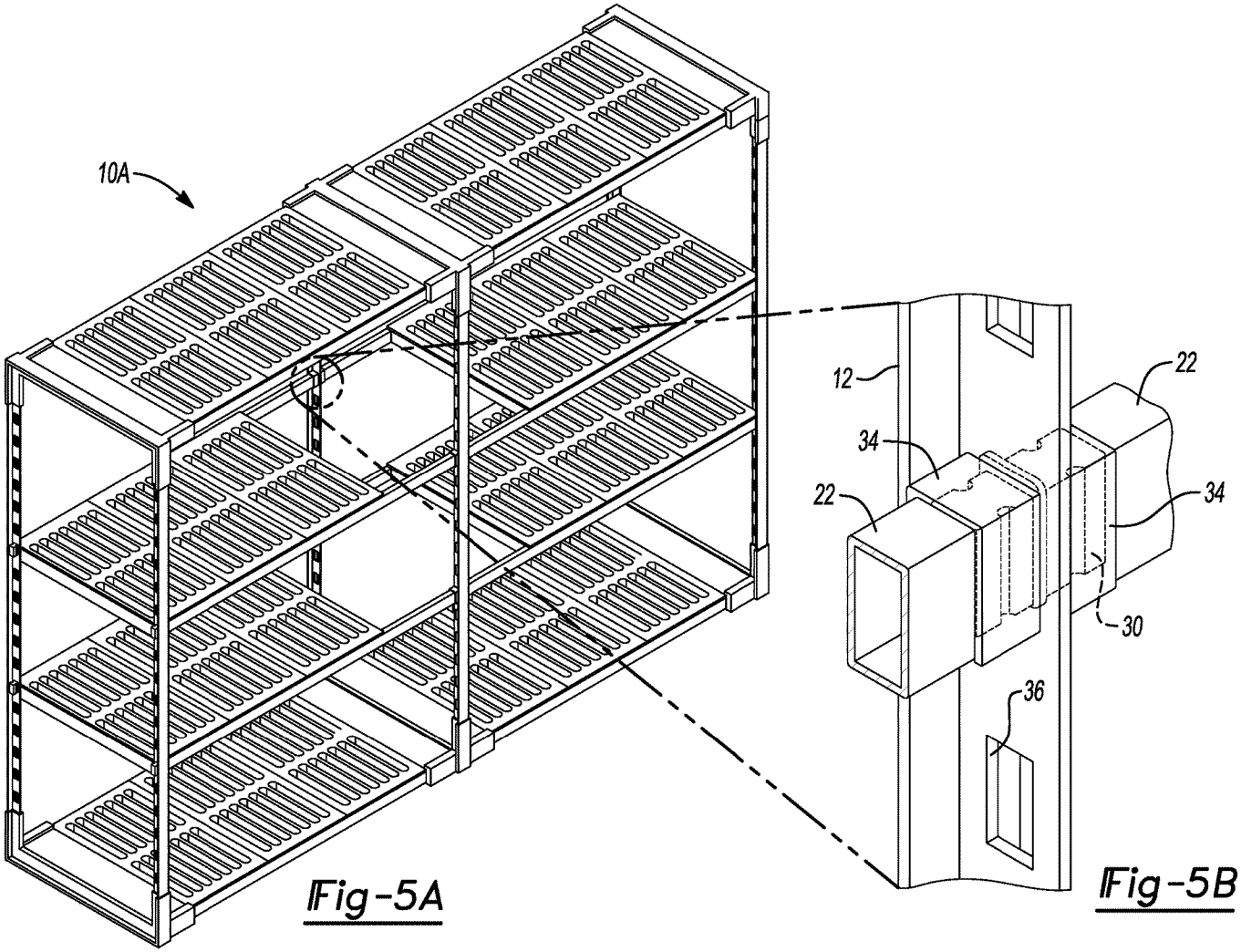
FIG. 5A is a perspective view of an alternative fully assembled shelving assembly system of FIG. 2.
FIG. 5B is an enlarged detail showing a portion of FIG. 5A.
Figure 6A:
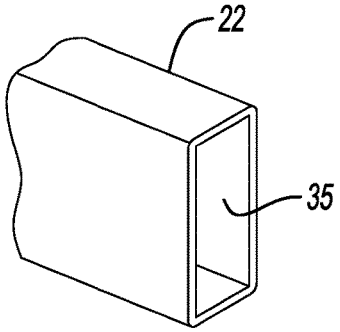
FIGS. 6A-6E illustrate an alternative shelf assembly system according to the principles of the present disclosure.
Figure 6B:
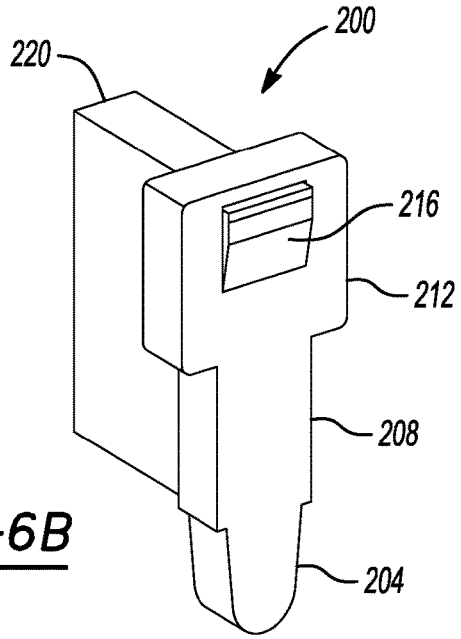
Figure 6C:
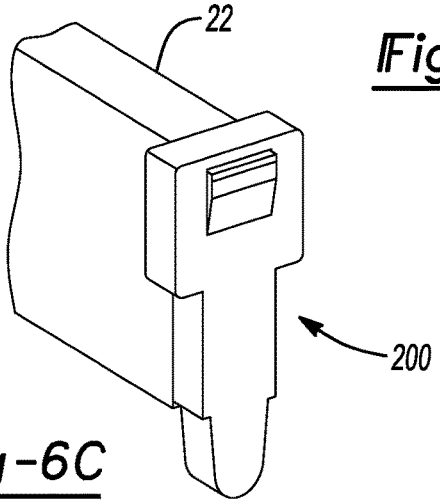
Figure 6D:
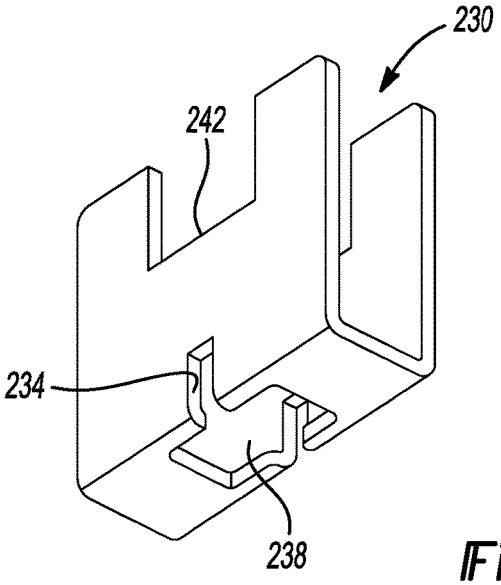
Figure 6E:
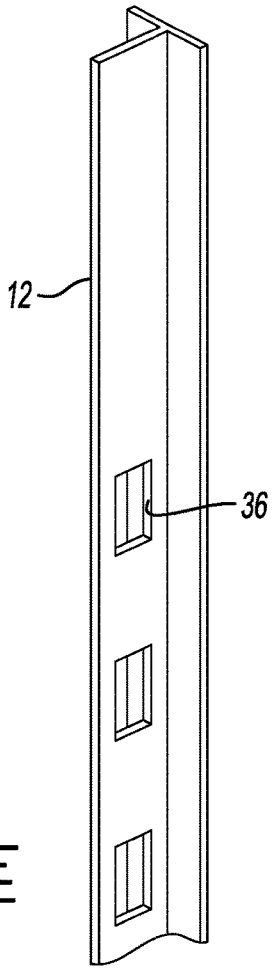

With reference to FIGS. 1B and 5A and 5B, an alternative shelving unit is illustrated generally at 10A. As illustrated in FIGS. 5A and 5B, an additional side beam 22 may be attached to the vertical post 22. For example, an additional side beam end piece 34 is press-fit into the additional side beam 22, as described above. The additional side beam connector 34 includes additional protrusions 33. Each of the second plurality of recessed portions 31 is configured to receive one of the additional protrusions 33 of the additional side beam connector 34. In other words, the end connector 30 is configured to receive a side beam 22, as described above, on either side of the stop 37. Further, additional side beams 22 may be attached in order to form shelves similar to those described with respect to the shelving unit 10.

Figure 4:
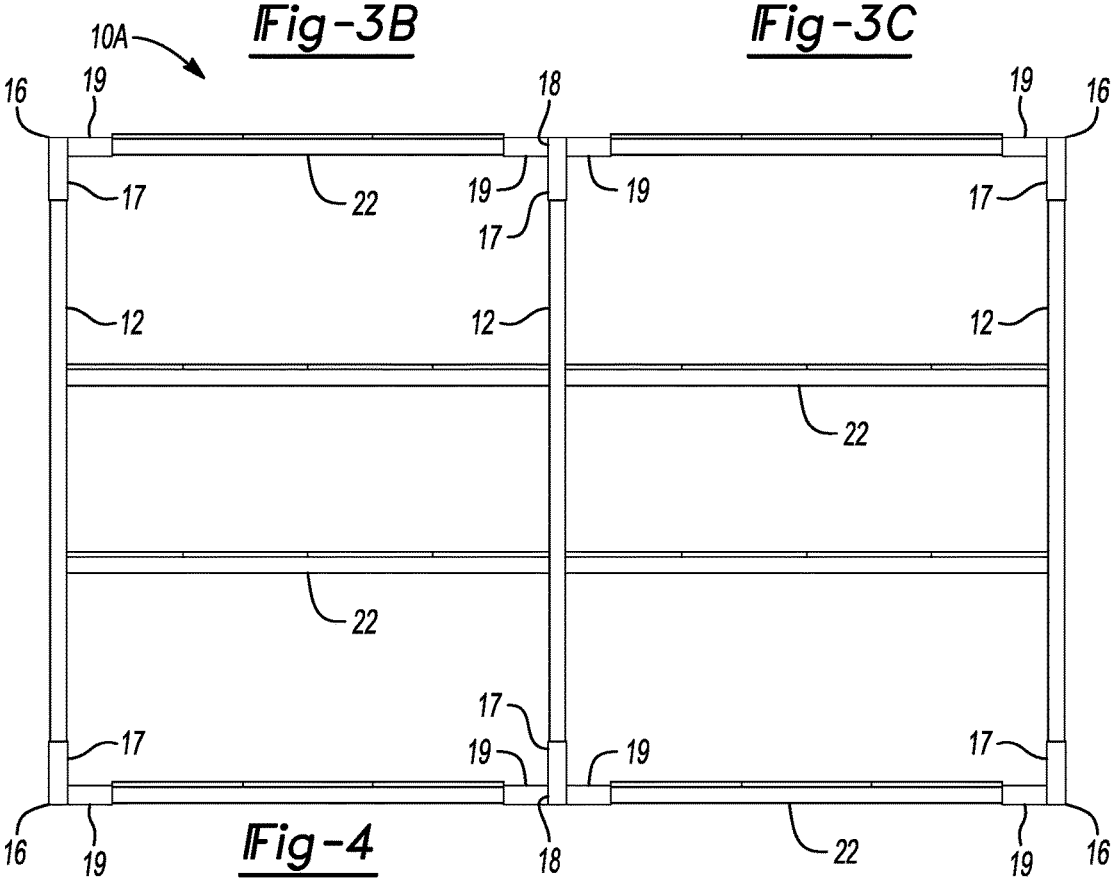
FIG. 4 is a front view of the alternative shelving unit of FIG. 1B.

In some implementations, additional components may be added to the shelving unit 10 in order to extend a length and/or load capacity of the shelving unit 10. For example, the alternative shelving until 10A includes additional side beams 22, additional vertical posts 12, and additional grid mats 20. Further, the alternative shelving unit 10A may include one or more alternative post connectors 18. With reference to FIG. 4, a front view of the alternative shelving unit 10A is generally depictured. Each of the alternative post connectors 18 includes a post receiving portion 17, similar to the post receiving portion 17 of the post connector 16. It is understood a vertical post 12 may be received by the post receiving portion 17 in any manner described above.

Additionally, each alterative post connectors 18 includes two side beam receiving portions 19. In this manner, the alternative post connectors 18 act as a coupling mechanism between a first shelving unit and a second shelving unit. For example, the each alternative post connector 18 receives a vertical post 12 and two side beams 22. The alternative shelving unit 10A may also include additional shelves, as described above.

In some implementations, the shelve assembly system includes a side beam end piece 200 and an end connector 230 as illustrated in FIGS. 6A-6E. The end piece 200 may be comprised of a polymer material and the end connector 230 may be comprised of sheet metal. The alternative shelve assembly system further includes one or more side beams 22 and one more vertical posts 12. As described above, the side beam 22 includes a bore 35 and the vertical beam includes a plurality of openings 36. The plurality of openings 36 may be rectangular shaped openings, or any other suitably shaped openings.

The end piece 200 includes a connection portion 220. The bore 35 is configured to receive the connection portion 220. For example, the bore 35 may be a rectangular shaped bore. The connection portion 220 may be a rectangular shaped protrusion configured to be slightly smaller than the bore 35. In other words, the connection portion 220 is configured to fit within the bore 35.

The end piece 200 also includes an end portion 204, a middle portion 208, and an upper portion 212. The end piece 200 also includes a locking portion 216. The locking portion 216 is disposed on an outer surface of the upper portion 212. The locking portion 216 is angled such that a portion of the locking portion 216 that is closer to the middle portion 208 protrudes away from the upper portion 212 at a lesser angle than a portion of the locking portion 216 that is relatively further away from the middle section 212. The angle is predetermined such that the locking portion 216 can be wedged into one of the plurality of openings 36 and provides a withdrawal resistance, as will be described in detail below.

The end connector 230 includes a recessed portion 238 disposed on a bottom surface of the end connector 230. The recessed portion 238 includes a cutout portion 234, disposed at or near a center of the recessed portion 238, and configured to engage an edge of one of the plurality of openings 36 in order to hold the end connector 230 in place, as will be described below. The end connector 230 also includes one or more receiving portions 242. For example, the end connector 230 may include a receiving portion 242 on a first side of the end connector 230 and another receiving portion 242 on a second side of the end connector 230. The first side is opposite the second side.

In one example, the end piece 200 is press-fit, or attached in any suitable fashion, to the side beam 22. The end connector 230 is inserted into one of the plurality of openings 36. The cutout portion 234 engages an edge of the opening 36. In this manner, the cutout portion 234 allows the end connector 230 to stay in place on the edge of the opening 36. The end portion 204 is inserted into the recessed portion 238 and the middle section 208 is inserted into a space between the recessed portion 238 and the one or more receiving portions 242. The recessed portions 242 are configured to receive the upper portion 212. For example, the assembler inserts the end piece far enough into the end connector 230 that the upper portion 212 rests on the receiving portions 242.

The assembler may then push the end piece 200 toward the opening 36. The locking portion 216 engages an edge of the opening 36 opposite the end connector 230. Due to the upper portion of the locking portion 216 protruding away from the upper portion 212, the locking portion 216 snaps into the opening 36 and resists withdrawal from the opening 36.

In other implementations the shelf assembly system includes an end piece 300, a side beam 22', and the vertical post 12. The end piece 300 may be comprised of a polymer material and includes two flexible portions 304, an upper portion 308, and a stop 312. The flexible portions 304 are disposed on either side of the end piece 300 and below the upper portion 308. In some implementations, the end piece 300 may include a gap between the flexible portions 304 and the upper portion 308.

Each of the flexible portions 304 include an inserting portion 305 disposed on the flexible portion 304 on an opposite side of the end piece 300 from the stop 312. Each of the flexible portions 304 is configured to flex inward toward each other when a force is applied to the inserting portions 305. Each of the flexible portions 304 also includes a barb 306. Each of the barbs 306 is configured to protrude outward from the flexible portion 304. In one example, the flexible portions 304 gradually ramp outward between the inserting portions 305 and the barbs 306.

Figure 7A:
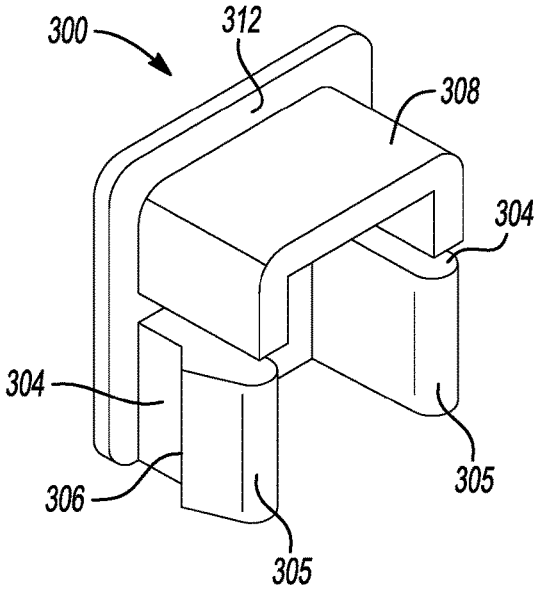
FIGS. 7A-7C illustrate another alternative shelf assembly system according to the principles of the present disclosure.
Figure 7B:
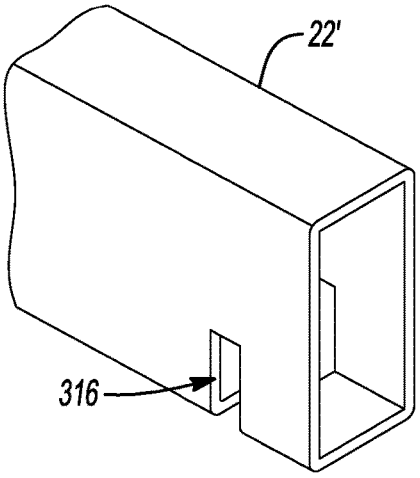
Figure 7C:
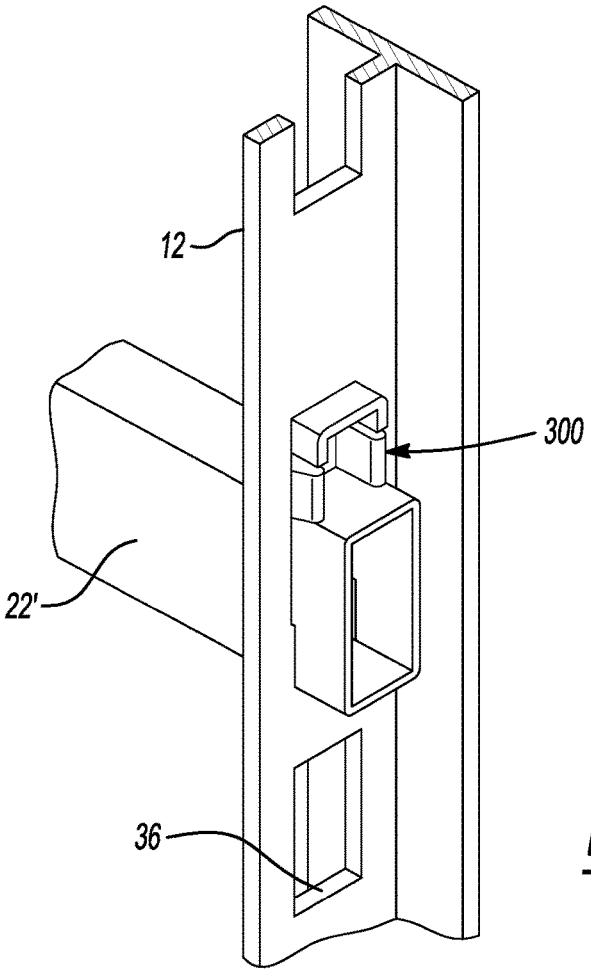

The side beam 22' includes a cut out portion 316 disposed on a bottom portion of the side beam 316. The cut out portion 316 is configured to rest on a first edge of one of the plurality of openings 36 of the vertical post 12. For example, the assembler inserts the side beam 22' into one of the openings 36. The assembler then presses the side beam 22' downward such that the cut out portion 316 slides onto the first edge of the opening 36, as illustrated in FIG. 7C.

The cut out portion 316 is cut deep enough into the side beam 22' such that when the side beam 22' is inserted into the opening 36, a gap is created between an upper portion of the side beam 22' and a second edge of the opening 36 that is opposed to the first edge. The end piece 300 is configured to fit within the gap. For example, the assembler inserts the end piece 300 into the gap. A force is applied to inserting portions 305 that cause the flexible portions 304 to flex inward toward each other. The assembler inserts the end piece 300 until the stop 312 makes contact with the vertical post 12. The stop 312 is configured to be slightly larger than the openings 36.

When the stop 312 makes contact with the vertical post 12, each of the flexible portions 304 return to an original position. In this manner, each of the barbs 306 extends beyond the opening 36 preventing withdrawal of the end piece 300. In other words, the barbs 306 are configured to protrude outward from the flexible portions 304 such that the end piece 300 can be inserted into the opening 36 and held in a horizontal positon by the barbs 306. The end piece 300 is held in a vertical position by the upper portion 308.

Figure 18A:
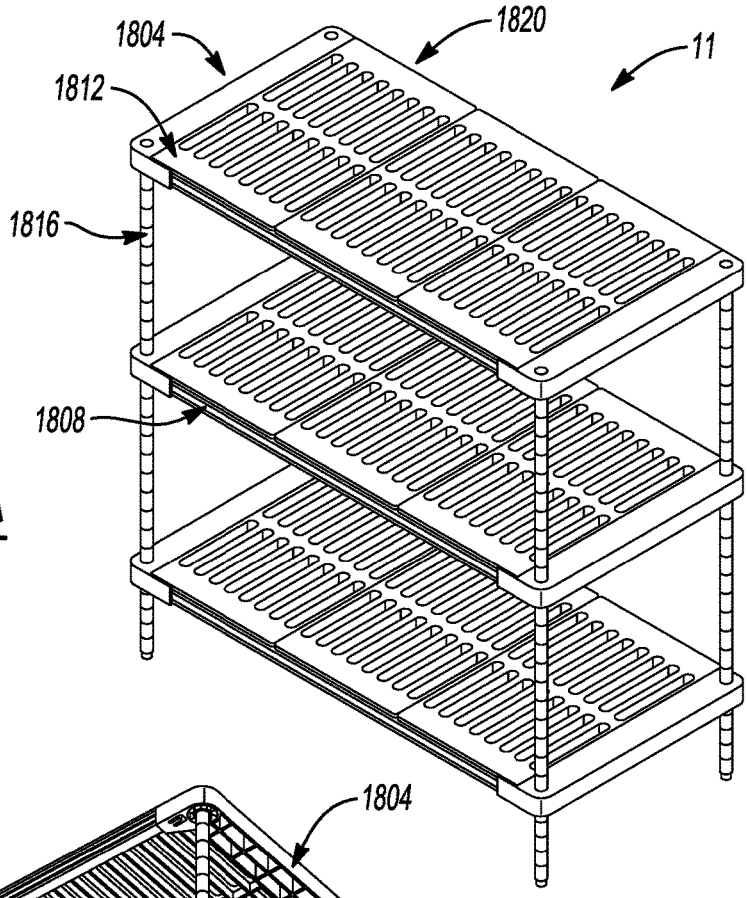
FIGS. 18A-18B illustrate another alternative shelving unit according to the principles of the present disclosure.
Figure 18B:
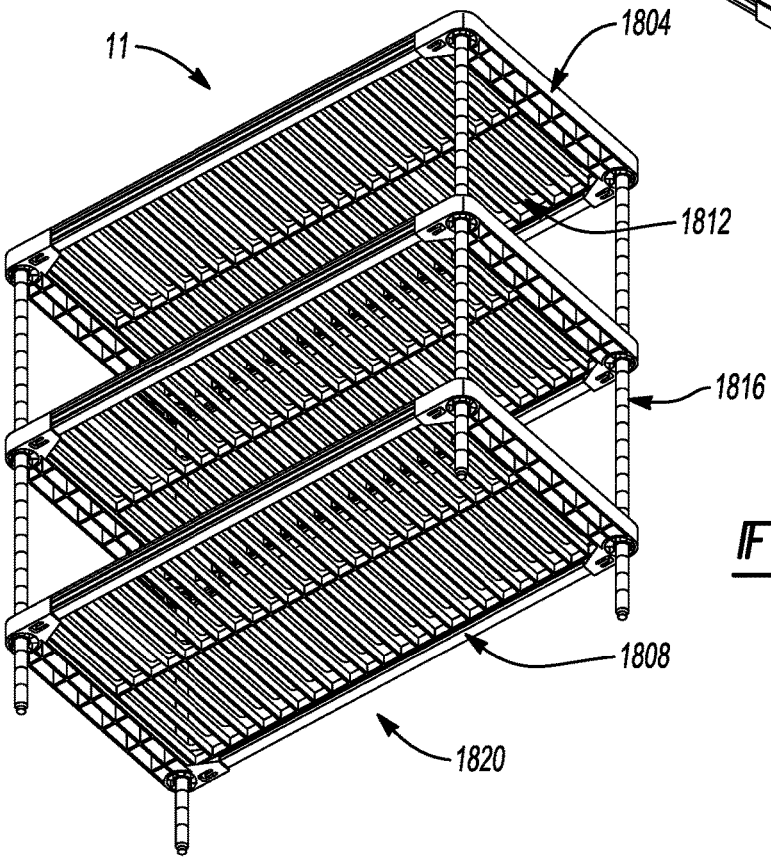

With reference to FIGS. 18A-18B, another alternative shelving unit is illustrated generally at 11. The shelving unit 11 includes a plurality of end beams 1804, a plurality of side beams 1808, a plurality of grid mats 1812, and a plurality of vertical posts 1816. In one example, the shelving unit 11 includes six end beams 1804, six side beams 1808, nine grid mats 1812, and four vertical posts 1812.

As will be described in detail below, each of the side beams 1808 are coupled to each of the end beams 1804 in a variety of manners. For example, a shelf frame assembly 1820 includes two end beams 1804, two side beams 1808, and one or more grid mats 1812. A first end beam 1804 receives a first end of a first side beam 1808 and a third end of a second side beam 1808. Further, a second end beam 1804 receives a second end of the first side beam 1808 and a fourth end of the second side beam 1808. The side beams 1808 then receive one or more of the plurality of grid mats 1812.

With reference to FIGS. 8A-8D, a shelf frame assembly system is illustrated generally at 400. The system 400 includes a side beam 22A, an end beam 402, a snap mechanism 404, and a taper insert 408. In one example, the side beam 22A is an 'I' beam, the snap mechanism 404 is comprised of sheet metal, and the taper insert 408 is comprised of a polymer material.

Figure 8A:
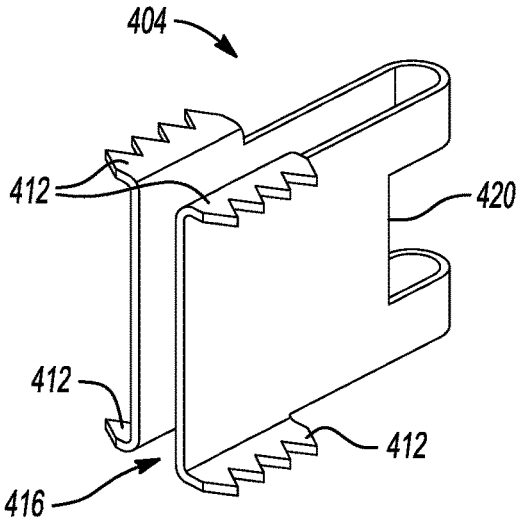
FIGS. 8A-8D illustrate a shelf frame assembly system according to the principles of the present disclosure.
Figure 8B:
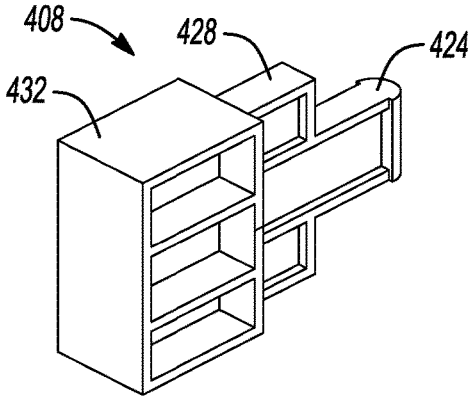
Figure 8C:
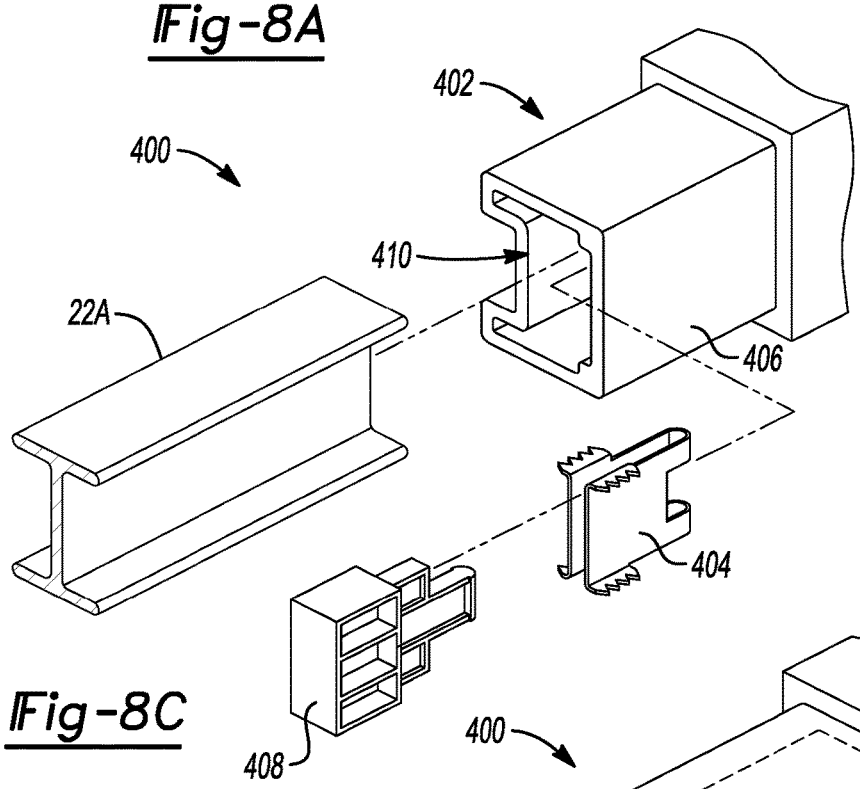
Figure 8D:
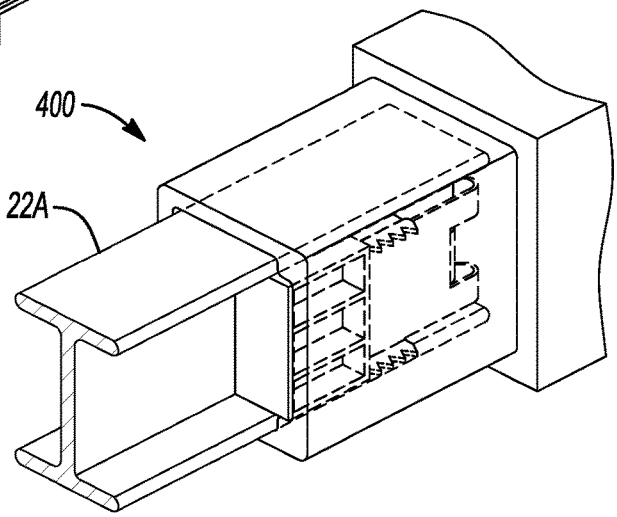

The snap mechanism 404 includes a plurality of toothed portions 412 protruding outward from an outer surface of the snap mechanism 404. In one example, the snap mechanism 404 includes four toothed portions 412. For example, the snap mechanism 404, as illustrated in FIG. 8A, includes two toothed portions 412 disposed on opposite sides of an upper portion of the snap mechanism 404 and two toothed portions 412 disposed on opposite sides of a lower portion of the snap mechanism 404.

The snap mechanism 404 also includes a first opening 416 and a second opening 420. The first opening 416 is disposed on an opposite side of the snap mechanism 404 from the second opening 420. The taper insert 408 includes an insert guide portion 424, an expansion portion 428, and a stop portion 432. In one example, the end beam 402 includes a coupling portion 406. The coupling portion 406 includes a recessed portion 410 configured to receive the side beam 22A.

When the side beam 22A is inserted into the recessed portion 410, a gap is created between the side beam 22A and an interior surface of the coupling portion 406. The snap mechanism 404 is configured to be inserted into the gap.

Once the snap mechanism 404 is inserted into the gap, an assembler inserts the taper insert 408 into the first opening 416 of the snap mechanism 404. For example, the first opening 416 is configured to receive the insert guide portion 424. As the assembler inserts the taper insert 408, the insert guide 424 passes through the second opening 420. The expansion portion 428 is slightly larger than the first opening 406. When the expansion portion 428 is inserted into the first opening 416, the snap mechanism 404 is expanded such that the toothed portions 412 engage an outer surface of the side beam 22A and the interior surface of the coupling portion 406.

In other words, the toothed portions 412 are jammed into the side beam 22A and the coupling portion 406, preventing withdrawal of the snap mechanism 404, the taper insert 408, and the side beam 22A from the coupling portion 406. The stop portion 428 is configured to contact an end of the snap mechanism 404, such that the assembler is preventing from inserting the taper insert 408 beyond the stop portion 408. While only one side beam 22A being coupled to one end beam 402 is described, it is understood a shelving frame assembly includes a plurality of side beams coupled to a plurality of end beams.

Figure 9A:
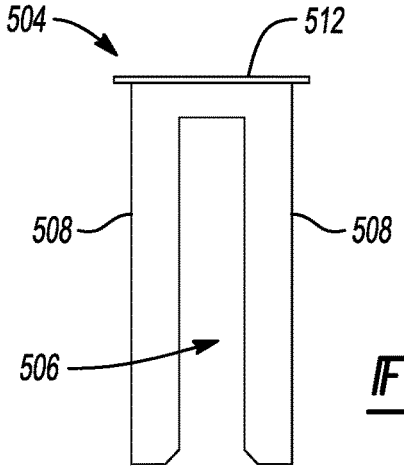
FIGS. 9A-9D illustrate an alternative shelf frame assembly system according to the principles of the present disclosure.
Figure 9B:
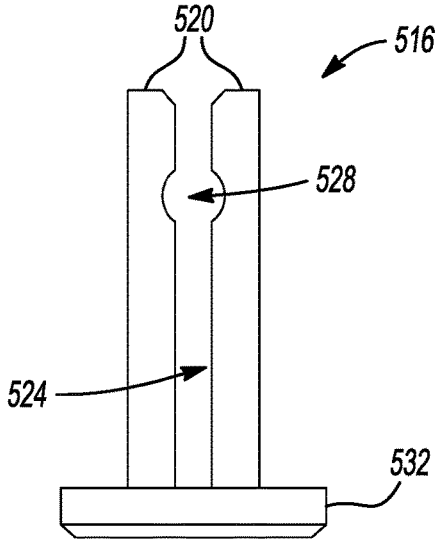
Figure 9C:
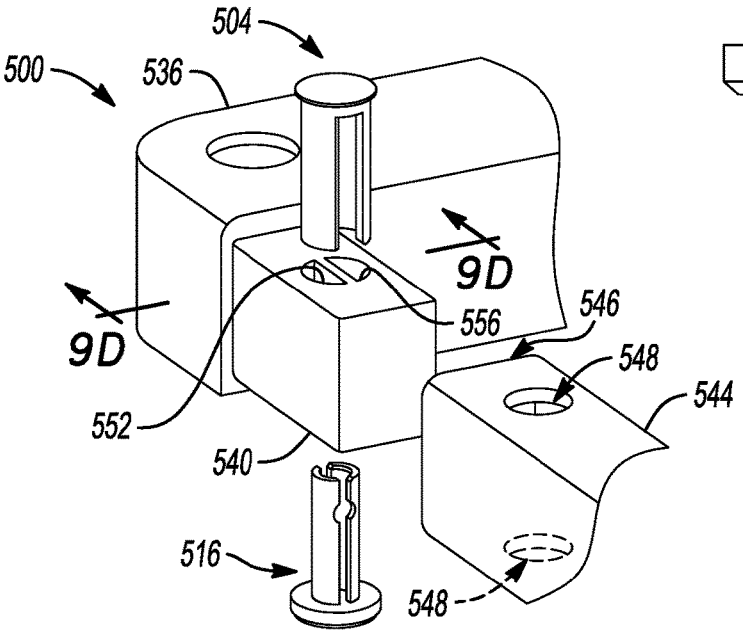
Figure 9D:
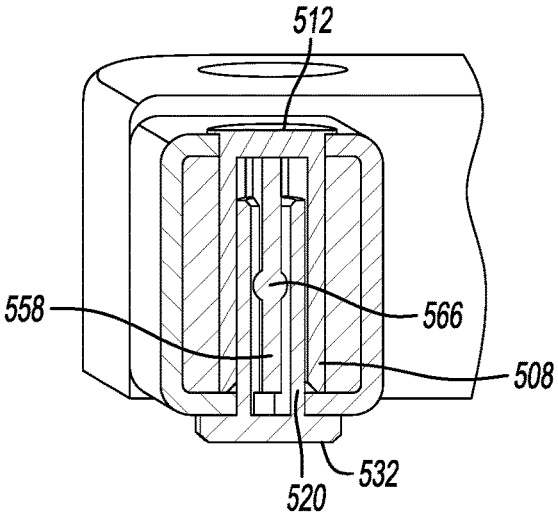

With reference to FIGS. 9A-9D, an alternative shelf frame assembly system is illustrated generally at 500. The system 500 includes a top cap 504 comprised of a polymer material, a bottom snap 516 comprised of a polymer material, an end beam 536, and a side beam 544. In one example, the end beam 536 includes a projection portion 540 protruding outward from the end beam 536. The projection portion 540 includes a first through bore 552 and a second through bore 556. The first through bore 552 and the second through bore 556 may comprise half circles disposed on opposite sides of a separating portion 558. The separating portion 558 includes a protrusion 566. In some examples, the protrusion 566 may comprise a spherical protrusion as illustrated in FIG. 9D.

The side beam 544 includes an opening 546 disposed on an end of the side beam 544 and two circular openings 548. In one example, a first circular opening 548 is disposed on an upper portion of the side beam 544 and a second circular opening 548 is disposed directly opposite of the first circular open 548 on a lower portion of the side beam 544. The opening 546 is configured to receive the projection portion 540. In other words, the opening 546 is slightly larger than the projection portion 540. In one example, the circular openings 548 are configured to align with the first through bore 552 and the second through bore 556 when the projection portion 540 is received by the opening 546.

The top cap 504 comprises a generally cylindrical shape. The top cap 504 includes two sides 508 and a recessed portion 506. The recessed portion 506 is disposed between each of the two sides 508. The top cap 504 further includes a stop portion 512.

The bottom snap 516 comprises a generally cylindrical shape and is configured to be received by the top cap 504. The bottom snap 516 includes two sides 520 and a recessed portion 524 disposed between each of the two sides 520. The bottom snap 526 also includes a spherical bore 528 and a stop portion 532. In some implementations, the assembler inserts the bottom snap 516 into the first through bore 552 and the second through bore 556.

For example, once the projection portion 540 is received by the opening 546 of the side beam 544, each side 528 of the bottom snap 516 may be inserted through the circular opening 548 disposed on the lower portion of the side beam 544 and into a corresponding one of the first through bore 552 and the second through bore 556. Each of the sides 520 are configured to temporarily flex outward when each of the sides 520 makes contact with the spherical protrusion 566. The spherical bore 528 is configured to receive the spherical protrusion 566.

When the spherical bore 528 receives the spherical protrusion 566, each of the sides 520 return to an original position. The stop 532 is configured to prevent the bottom snap from being inserted beyond the stop 532. For example, the stop 532 is slightly larger than the circular opening 548 disposed on the lower portion of the side beam 544. The bottom snap 516 is configured to create a gap between each of the sides 520 and an interior surface of the first through bore 552 and the second through bore 556.

The assembler then inserts each of the sides 508 of the top cap 504 into the first through bore 552 and the second through bore 556. For example, each of the sides 508 may be inserted through the circular opening 548 disposed on the upper portion of the side beam 544 and into a corresponding one of the first through bore 552 and the second through bore 556. Each of the sides 508 are configured to fit within the gap created by the sides 520 and the interior surfaces of the first through bore 552 and the second through bore 556 and prevent withdrawal of the bottom snap 516. In other words, the top cap 504 is press-fit into the gap, causing the bottom snap 512 to be frictionally held in place. The stop 512 is configured to prevent the top cap 504 from being inserted beyond the stop 512.

With reference to FIGS. 10A-10E, another alternative shelf frame assembly system is illustrated generally at 600. The system 600 includes an end connector 602, an end beam 620, and a side beam 634. In some implementations, the end connector 602 may be comprised of a polymer material and the end beam 620 and side beam 634 may be comprised of sheet metal, such as aluminum.

The end beam 620 includes one or more coupling portions 622. For example, the end beam 620 includes a coupling portion 622 disposed on a first end of the end beam 620 and a second end of the end beam 620. The coupling portion 622 includes a first side 626 and an opposed second side 628. The coupling portion 622 also includes a receiving portion 624 disposed between the first side 626 and the second side 628. Each of the first side 626 and the second side 628 include one or more holes 630. In some implementations, each of the first side 626 and the second side 628 include two holes. Each hole disposed on the first side 626 aligns with a corresponding hole on the second side 628.

The end connector 602 includes one or more recessed portions 604, a cylindrical through bore 608, a projection portion 612, and a stop portion 613. The cylindrical through bore 608 is configured to receive a vertical post 644. The vertical post 644 may be a cylindrical post with a diameter that is slightly smaller than a diameter of the cylindrical through bore 608.

The side beam 634 includes an opening 635 and one or more holes 636. In one example, the side beam 634 includes two holes 636 on a first side of the side beam 634 and two holes on an opposed second side of the side beam 634. Further, each of the holes 636 on the first side of the side beam 634 align to a corresponding hole on the second side of the side beam 634.

The opening 635 is configured to receive the projection portion 612. For example, the recessed portion 624 is slightly larger than the projection portion 612. The assembler inserts the projection portion 612 into the opening 635. The stop portion 613 makes contact with the side beam 634 and prevents the end connector 602 from being inserted into the opening 635 beyond the stop portion 613. Further, once the stop portion 613 makes contact with the side beam 634, the holes 636 align with the recessed portions 604.

The recessed portion 624 of the end beam 620 is configured to receive the side beam 634. For example, the recessed portion 624 is slightly larger than the side beam 634. The assembler pushes the coupling portion 622 onto the side beam 634 such that the holes 630 align with corresponding holes 636 and, therefore, the recessed portions 604. The end beam 620, the side beam 634, and the end connector 602 are held in place by one or more fasteners being inserted into the holes 630, the holes 636, and the recessed portions 604. In one example, a rivet is riveted into the end beam 620, the side beam 634, and the end connector 602 via the holes 630, the holes 636, and the recessed portions 604.

In another implementation, an alternative end beam 802 includes a coupling portion 806 as illustrated in FIGS. 12A-D. The coupling portion 806 is includes a bore 808 and the end connector 602. The bore 808 is configured to receive a vertical post, similar to those described above. The end beam 802 may be comprised of a polymer material. Similarly the end connector 602 may be comprised of a polymer material. In some implementations, the coupling portion 808 includes an insert 812. The insert 812 may be comprised of a rigid material, such as sheet metal.

In some implementations, the coupling portion 808 includes a single insert 812 that receives the end connector 602. The insert 812 and the end connector 602 are then received by the end beam 802. In another implementation, the coupling portion 808 includes one or more inserts 812. For example, the assembly aligns one of the inserts 812 with a first side of the end connector 602 and another of the inserts 812 with a second side of the end connector 602. The end connector 602 and the inserts 812 are then received by the end beam 802.

In some implementations, the end beam 802 includes a slot 810. The slot 810 may be disposed on an upper portion of the end beam 802. The slot 810 is configured to receive a coupling mechanism (not shown). One end of the coupling mechanism may be inserted into the slot 810. Another end of the coupling mechanism may be inserted into another slot disposed on another end beam of another shelving unit. In this manner, the slot 810 allows the end beam 802 (and therefore, a corresponding shelving unit) to be attached to another shelving unit.

Figure 11A:
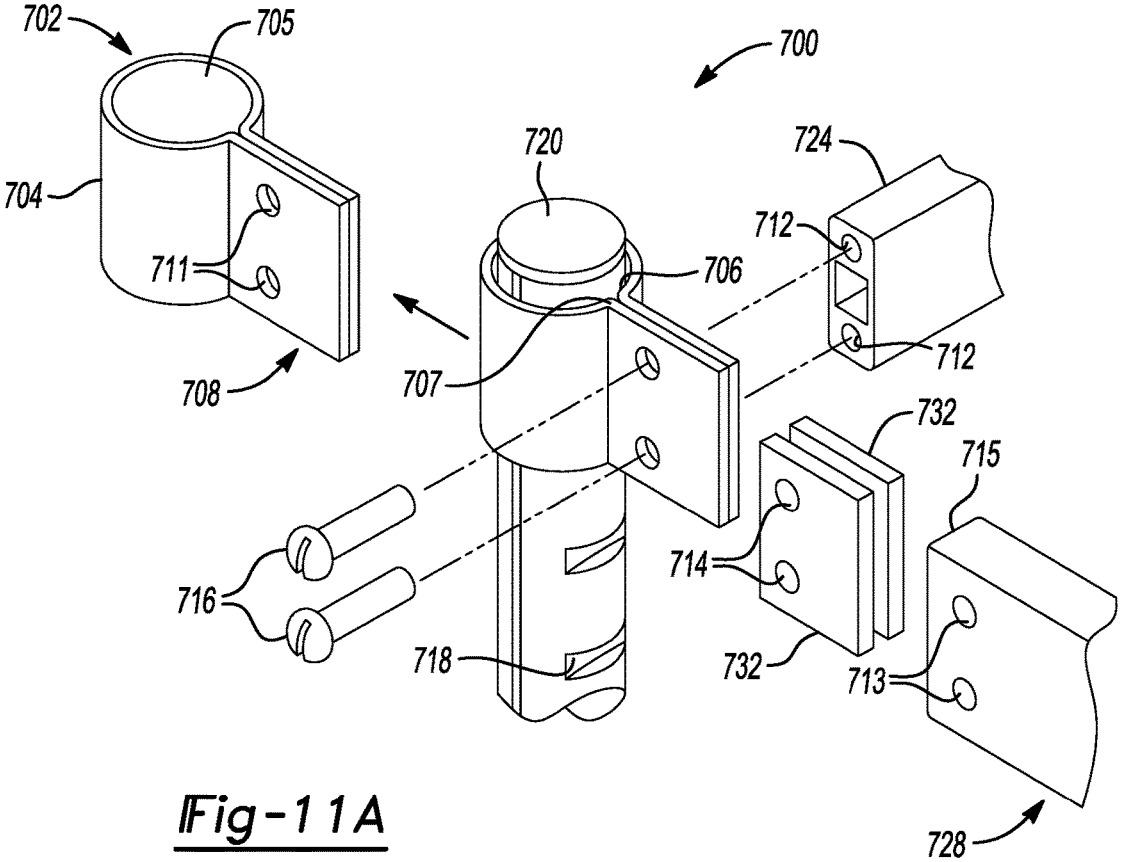
FIGS. 11A-11B illustrate another alternative shelf frame assembly system according to the principles of the present disclosure.
Figure 11B:
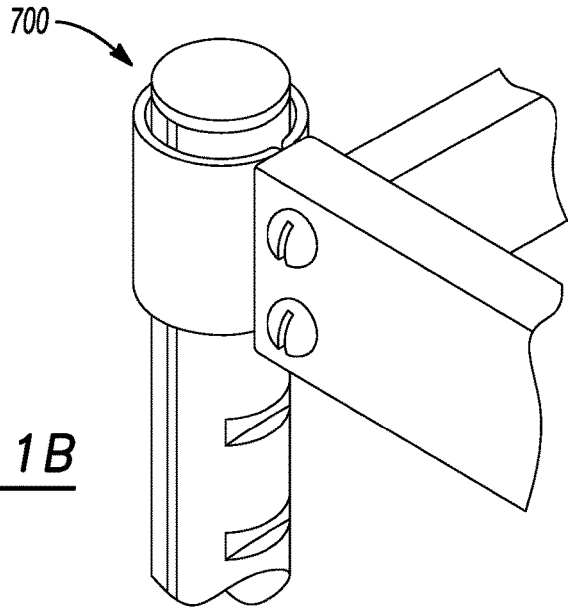
Figure 13A:
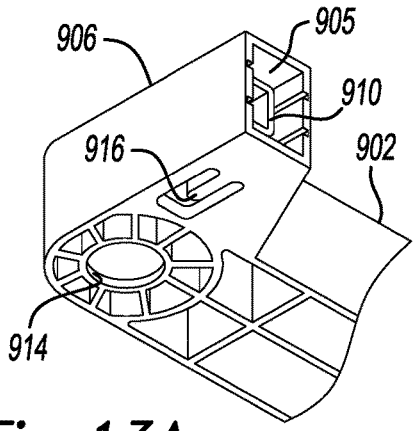
FIGS. 13A-13F illustrate another alternative shelf frame assembly system according to the principles of the present disclosure.
Figure 13B:
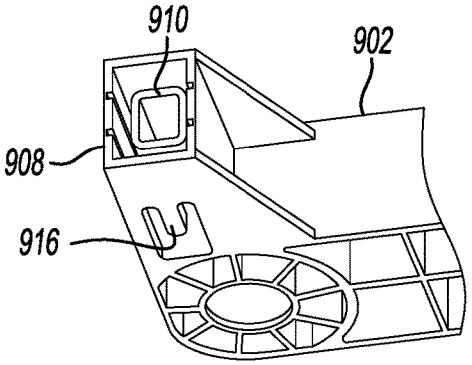
Figure 13C:
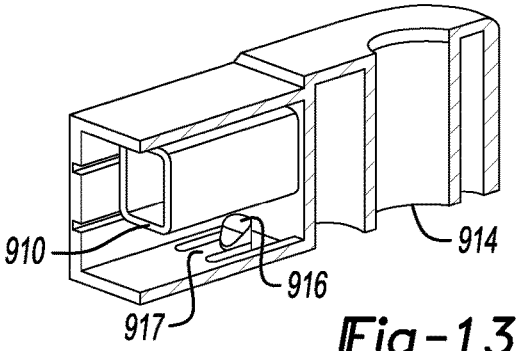
Figure 13D:
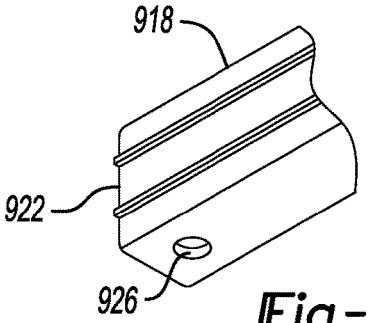
Figure 13E:
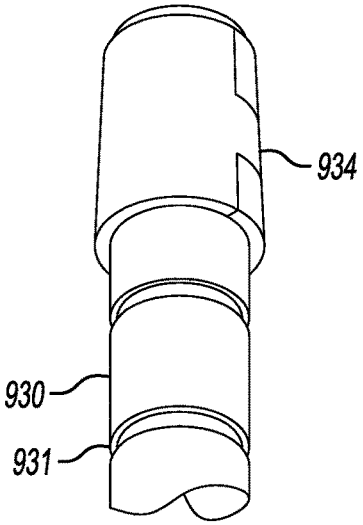
Figure 13F:
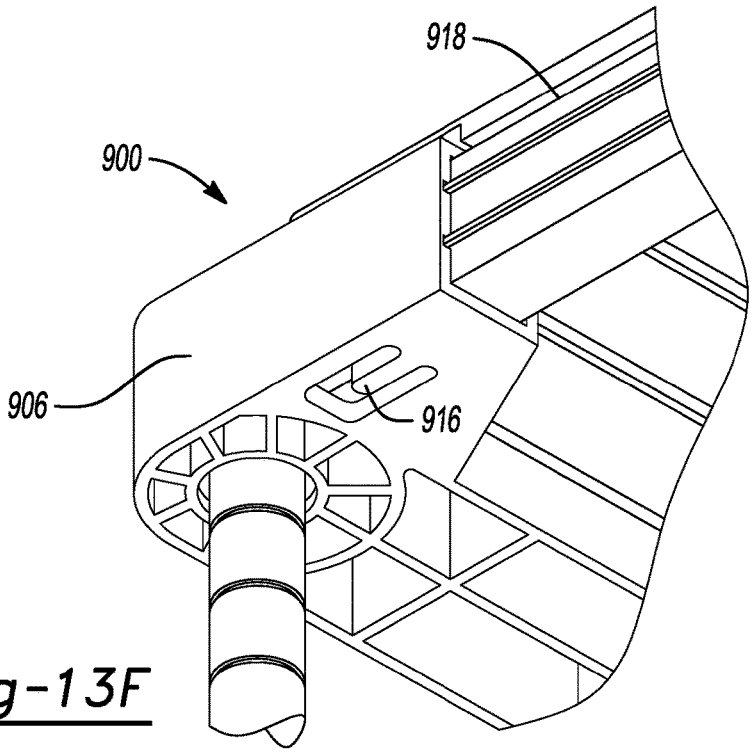
Figure 14A:
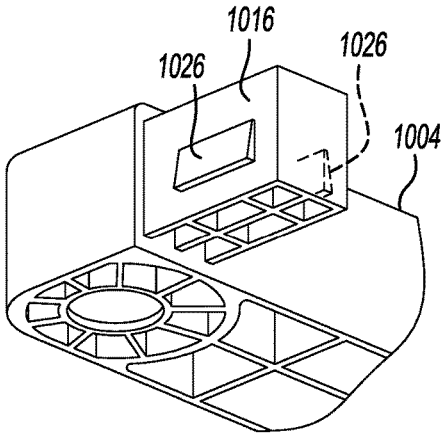
FIGS. 14A-14D illustrate another alternative shelf frame assembly system according to the principles of the present disclosure.
Figure 14B:
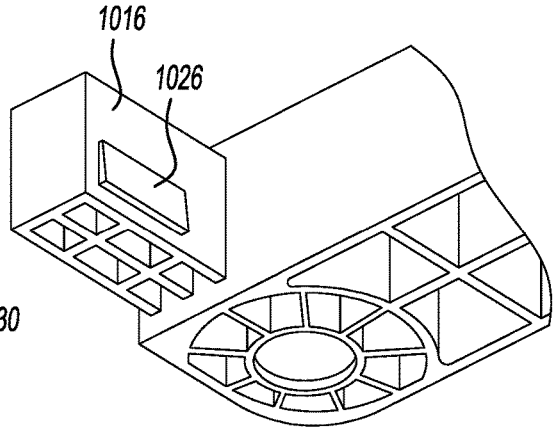
Figure 14C:
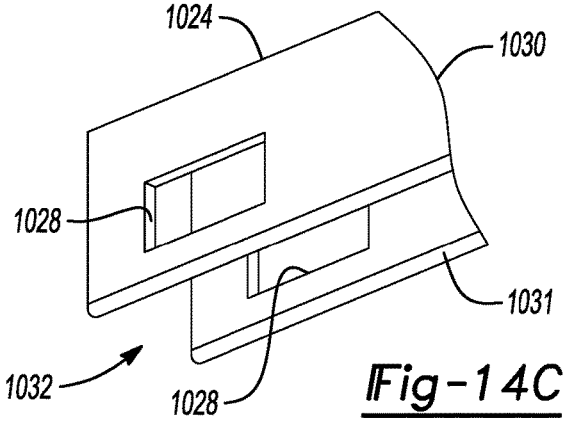
Figure 14D:
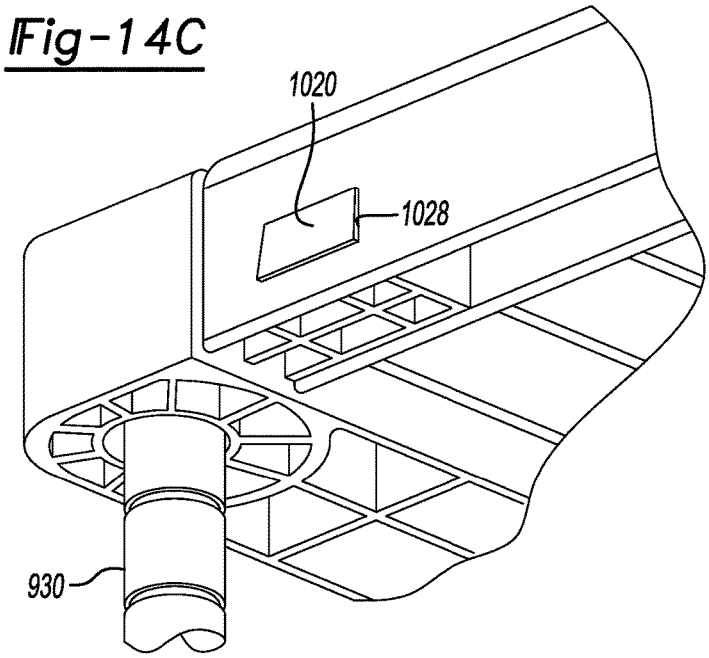
Figure 15A:
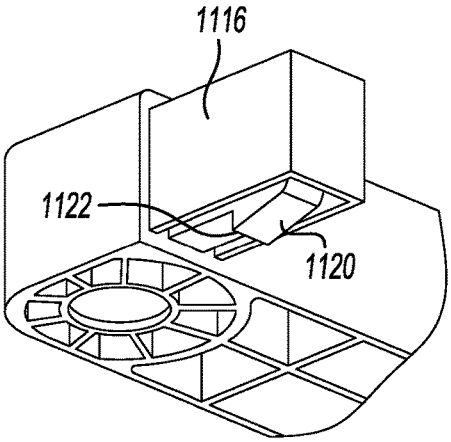
FIGS. 15A-15D illustrate another alternative shelf frame assembly system according to the principles of the present disclosure.
Figure 15B:
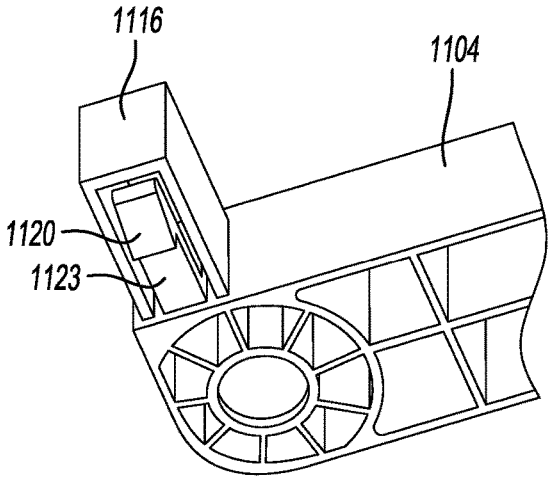
Figure 15C:
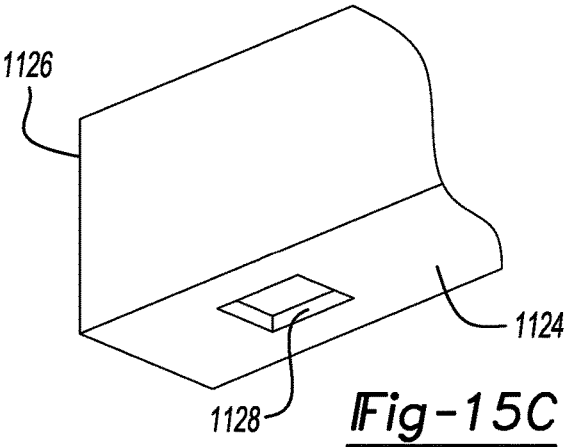
Figure 15D:
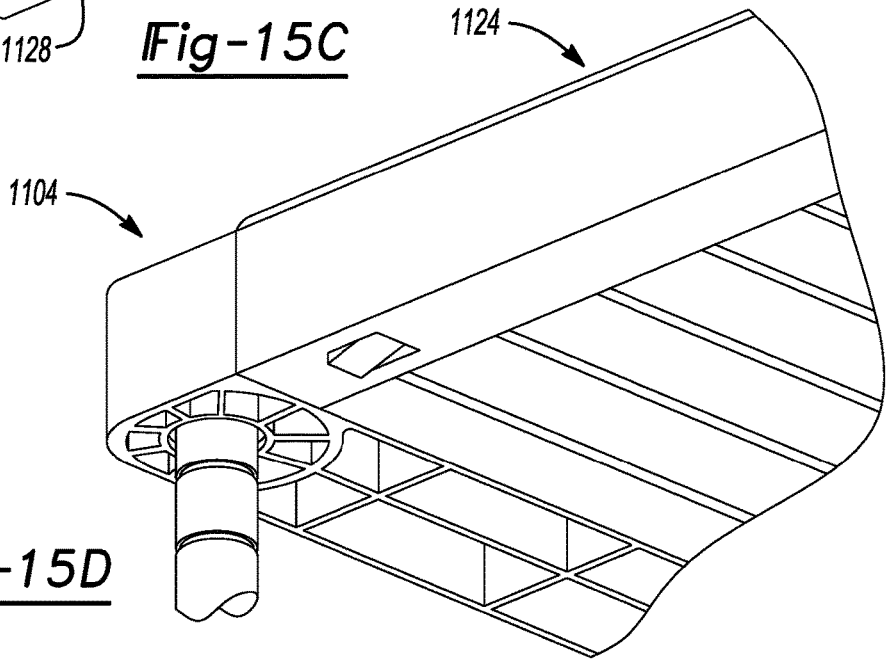

With reference to FIGS. 11A-11B, another alternative shelf frame assembly system is illustrated generally at 700. The system 700 includes an end collar 702, an end beam 724, a side beam 728, and one or more spacers 732. The end collar 702 includes a cylindrical portion 704. The cylindrical portion 704 comprises a cylindrical bore 705. The cylindrical bore 705 may be a tapered cylinder. For example, a diameter of the bore 705 at an upper portion of the cylindrical portion 704 may be smaller than a diameter of the bore 705 at a lower portion of the cylindrical portion 704.

The end collar 702 also includes flat portions 708. In some implementations, the end collar 702 includes a single flat portion 708 extending outward from the cylindrical portion 704. The end collar 702 may be configured to receive a vertical post 702. The vertical post 720 may be cylindrical and comprise a diameter that is slightly smaller than the diameter of the cylindrical bore 716 at the upper portion of the cylindrical portion 704. In this manner, the end collar 702 may be slid onto the vertical post 720.

In another implementation, the end collar 702 includes two flat portions 708 that are aligned with each other. Each of the two flat portions 708 is disposed on an end of the cylindrical portion 704. For example, the cylindrical portion 704 may include a first end 706 and a second end 707. The cylindrical portion 704 may be opened and/or closed. For example, the cylindrical portion 704 may comprise a flexible material, such as a polymer or flexible metal. When the first end 706 and the second end 707 make contact with each other, the cylindrical portion 704 is in a closed position. When the first end 706 and the second end 707 are spaced apart, the cylindrical portion 704 is in an open position.

In one example, each of the two flat portions 708 may be separated, such that, the first end 706 is separated from the second end 707. The assembler may then slide the collar horizontally onto the vertical post 720. The assembler aligns the two flat portions 708 with each other and closes the cylindrical portion 704 around the vertical post 720. In this manner, the end collar 702 may be opened and slid onto the vertical post 720 without having to slide the end collar onto the vertical post 720 from a top of the vertical post 720.

In some implementations, the vertical post 720 includes a plurality of notches 718. Each of the plurality of notches 718 indicates a predetermined height on the vertical post 720. The assembler slides the end collar 702 onto the vertical post 720 at a notch 718 corresponding to a desired shelf height.

Each of the flat portions 708 includes one or more holes 711. The one or more holes 711 are configured to receive one or more fasteners 716. In some implementations, each of the flat portions 708 includes two holes 711 passing horizontally through each of the flat portions 708. Further, each of the holes 711 on one of the flat portions 708 align with a corresponding one of the holes 711 on the other flat portion 708.

The end beam 724 may be generally rectangular in shape and be comprised of aluminum or other suitable material. The end beam 724 includes one or more bosses 712 configured to receive the one or more fasteners 716. The bosses 712 are disposed in an opening at an end of the end beam 724. In one example, the end beam 724 includes two bosses 712.

The side beam 728 may be generally rectangular in shape and be comprised of aluminum or other suitable material. The side beam 728 includes one or more holes 713 disposed on each side of the side beam 728. The holes 713 are configured to receive the one or more fasteners 716. In one example, the side beam 728 includes two holes 713 on a first side of the side beam 728 and two holes 713 on an opposed second side of the side beam 728. Each of the holes 713 disposed on the first side align with a corresponding one of the holes 713 disposed on the second side.

The side beam 728 also includes an opening 715. The opening 715 is disposed at an end of the side beam 728. The opening 715 is configured to receive the flat portions 708 and the spacers 732. For example, the spacers 732 may be generally rectangular in shape and configured to have a height equal to a height of the opening 715. The system 700 includes one or more spaces 732. In one example, the system 700 includes two spacers 732. The spacers 732 include one or more holes 714 configured to receive the one or more fasteners 716. In one example, the spacers 732 each include two holes 714 passing horizontally through each of the spacers 732. Further, each of the holes 714 on one of the spacers 732 aligns with a corresponding one of the holes 714 on the other spacer 732.

The assembler aligns the spacers 732 with the flat portions 708. For example, the assembler placers one spacer 732 on a first side of the flat portions 708 and another spacer 732 on a second side of the flat portions 708. The assembler aligns the spacers 732 with the flat portions 708 such that each of the holes 714 aligns with a corresponding one of the holes 711. The assembler inserts the flat portions 708 and the spacers 732 into the opening 715 such that each of the holes 713 align with a corresponding one of the holes 714, and therefore a corresponding one of the holes 711. The assembler then aligns the end beam 724 at or near a 90° angle from the side beam 728 such that the bosses 712 align with a corresponding one of the holes 713, and therefore a corresponding one of the holes 714 and 711.

The assembler then applies a driving force to the one or more fasteners 716 in order to drive the fasteners 716 through the holes 714, 713, and 711 and into the bosses 712. In one example, the fasteners 716 may comprise screws that are driven into the bosses via a screw driver or drill. The fasteners 716 may be self-tapping screws, rivets, nails, or any other suitable fastener.

With particular reference to FIGS. 13A-13F, another alternative shelf frame assembly system is illustrated generally at 900. The system 900 includes an end beam 902, a side beam 918, a vertical post 930, and a sleeve 934. The end beam 902 may be comprised of polymer material and the side beam 928 may be generally rectangular and comprised of aluminum or other suitable material.

The end beam 902 includes a coupling portion 906. The coupling portion 906 includes an opening 905 disposed at an end of the coupling portion 906. The opening 905 is configured to receive an end of the side beam 918. In some implementations, the coupling portion 906 includes a guide 910. The guide 910 is disposed within the opening 905 and protrudes outward from the end beam 902.

In some implementations, the guide 910 is slightly smaller than an opening 922 of the side beam 918 such that the opening 922 receives the guide 910. For example, the assembler inserts the end of the side beam 918 into the opening 905. The opening 922 receives the guide 910. In this manner, the guide 910 aligns the side beam 918 at an appropriate angle relative to the end beam 902.

The end beam 902 includes a cylindrical bore 914. The cylindrical bore 914 is configured to receive the sleeve 934. In some implementations, the sleeve 934 is comprised of a single piece configured to slide onto the vertical post 930. In another implementation, the sleeve 934 is comprised of two or more pieces. For example, the sleeve 934 includes a first side and a second side. The first side may include one or more clip portions and the second side may include one or more snap portions. Each of the clip portions is configured to receive a corresponding one of the snap portions. In this manner, the sleeve 934 may be assembled around the vertical post 930.

The vertical post 930 includes a plurality of notches 931, similar to the notches 718 described with respect to FIGS. 11A-11B. The assembler assembles the sleeve 934 at one of the plurality of notches 931 corresponding to a desired height of the end beam 902. The sleeve 934 includes outer diameter that is slightly smaller than a diameter of the cylindrical bore 914.

The assembler slides the end beam 902 over the vertical post 903 and onto the sleeve 934. The sleeve 934 may include a tapered portion near a lower portion of the sleeve 934 configured to prevent the end beam 902 from passing beyond the lower portion of the sleeve 934. For example, the lower portion of the sleeve 934 may be larger than the cylindrical bore 914. Additionally or alternatively, the sleeve 934 may include a stop configured to prevent the end beam 902 from passing beyond the sleeve 934.

The coupling portion 906 includes a protrusion 916 disposed on a lower portion of the coupling portion 906 and protruding up and inward into the opening 905. The protrusion 916 may comprise a flexible portion 917 configured to temporarily flex when the side beam 918 makes contact with the protrusion 916. The side beam 918 includes a hole 926 disposed on a lower portion of the side beam 918. The assembler inserts the side beam 918 into the opening 905. The side beam 918 makes contact with the protrusion 916.

The flexible portion 917 flexes such that the protrusion is pushed beneath the lower portion of the side beam 918. The protrusion 916 snaps into the hole 926 when the hole 926 is directly above the protrusion 916. The protrusion locks the side beam 918 into place and prevents withdrawal of the side beam 918 from the coupling portion 906.

In some implementations, an alternative end beam 1004 includes a coupling portion 1016 as illustrated in 14A-14D. The end beam 1004 may be comprised of a polymer or other suitable material. The coupling portion 1016 includes one or more projections 1026. In one example, the coupling portion 1016 includes a projection 1026 on each side of the coupling portion 1016. The projections 1026 extend outward from the coupling portion 1016 at an angle such that a lower portion of the projections 1026 extend further away from the coupling portion 1016 than an upper portion of the projections 1016.

An alternative side beam 1024 be comprised of aluminum or other suitable material and include a "C" shaped channel 1032. For example, the side beam 1024 comprises a top portion, a first side 1030, and a second side 1031. The first side 1030 and the second side 1031 define the channel 1032. The channel 1032 is configured to receive the coupling portion 1016. For example, the coupling portion 1016 is slightly smaller than the channel 1032.

Each of the first side 1030 and the second side 1031 includes a hole 1028. Each of the holes 1028 is configured to receive a corresponding one of the projections 1026. For example, the assembler presses the side beam 1024 downward onto the coupling portion 1016. Each of the first side 1030 and the second side 1031 makes contact with a corresponding one of the projections 1026. The assembler continues to push downward on the side beam 1024 until the lower portion of each of the projections 1026 is aligned with corresponding ones of the holes 1028.

The projections 1026 snap into the holes 1028. The projections 1026 are configured to extend through the holes 1028 and beyond the first side 1030 and the second side 1031. In this manner, the projections lock the side beam 1024 in place and prevent separation of the side beam 1024 from the coupling portion 1016.

In other implementations, an alternative end beam 1104 includes a coupling portion 1116 as illustrated in FIGS. 15A-15D. The coupling portion 1116 includes a snap mechanism 1120. The snap mechanism 1120 is disposed on a lower surface of the coupling portion 1116. The snap mechanism 1120 includes a barb 1122 and a flexible portion 1123 configured to temporarily flex when an alternative side beam 1124 makes contact with the snap mechanism 1120.

The side beam 1124 may be generally rectangular and be comprised of aluminum or other suitable material. The side beam 1124 includes an opening 1126 disposed at an end of the side beam 1124 and configured to receive the coupling portion 1116. The side beam 1124 further includes a hole 1128 disposed on a lower portion of the side beam 1124. The hole 1128 is configured to receive the barb 1122.

The assembler slides the side beam 1124 onto the coupling portion 1116. An edge of the opening 1126 makes contact with the snap mechanism 1120. The flexible portion 1123 flexes, pushing the snap mechanism 1120 into the opening 1126. When the barb 1122 is directly aligned with the hole 1128, the barb 1122 snaps into the hole 1128. The barb 1122 is configured to extend through the hole 1128 and beyond the lower portion of the side beam 1124. In this manner, the barb 1122 locks the side beam 1124 in place.

Figure 17A:
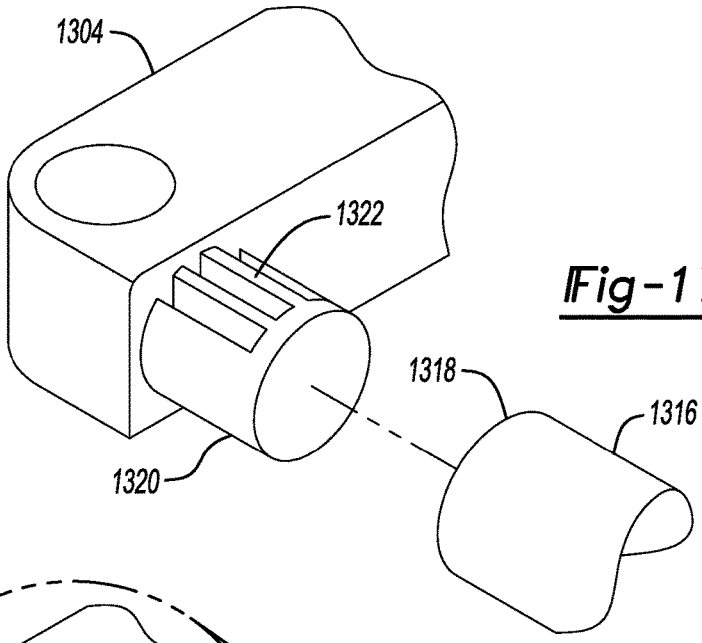
FIGS. 17A-17C illustrate another alternative shelf frame assembly system according to the principles of the present disclosure.
Figure 17B:
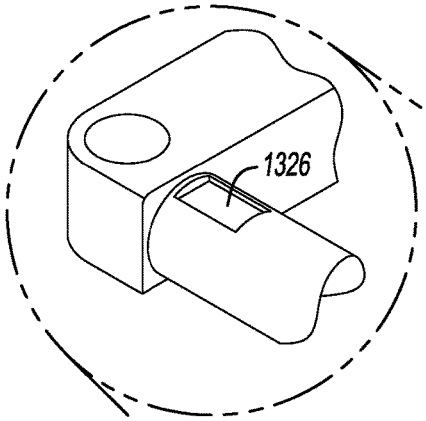
Figure 17C:
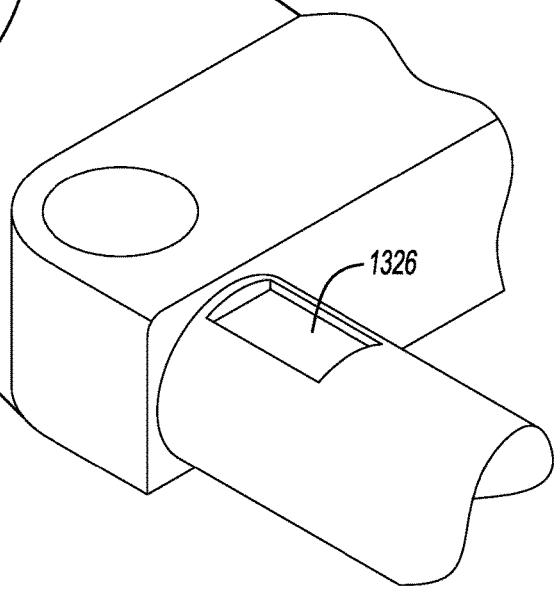

In other implementations, another alternative end beam 1304 includes a coupling portion 1320, as illustrated in FIGS. 17A-17C. The coupling portion 1320 extends outward from the end beam 1304. In some examples, the coupling portion 1320 may be a generally cylindrical and extend horizontally outward from the end beam 1304.

The coupling portion 1320 includes a plurality of projections 1322. The plurality of projections 1322 may be disposed on an upper portion of the coupling portion 1320. Each of the projections 1322 comprises rigid body that projects away from the coupling portion 1320.

A side beam 1316 may comprise a hollow cylindrical tube. The side beam 1316 includes a receiving opening 1318. The receiving opening 1318 is configured to receive the coupling portion 1320. In one example, a diameter of the side beam 1316 is slightly larger than a diameter of the coupling portion 1320. The assembler inserts the coupling portion 1320 into the opening 1318. The assembler than crimps a portion of the side beam 1316 to the coupling portion 1320. For example, the assembler may use a tool, such as a crimping tool, to crimp a portion of the side beam 1316 that is directly above the projections 1322.

The tool (not shown) may be configured to crimp the side beam 1316 into the projections 1322. In other words, the side beam 1316 may be deformed and force a portion of the side beam 1316 between each of the projections 1322. In this manner, the projections 1322 lock the side beam 1316 in place.

With reference to FIGS. 16A-16E, an alternative shelf frame assembly system is illustrated generally at 1200. The system 1200 includes an end beam 1204, a side beam 1220, and a cap 1128. The end beam 1204 includes a coupling portion 1208. The coupling portion 1208 includes a receiving bore 1209. The receiving bore 1209 is configured to receive a vertical post 1211. For example only, the receiving bore 1209 may comprise a diameter that is slightly larger than a diameter of the vertical post 1211. It is understood that the coupling portion 1208 may be configured to receive a vertical post in any manner described above.

The coupling portion 1208 also includes one or more projections 1216 and one or more grooves 1210. The projections 1216 may project upward from the end beam 1204. Further, each of the projections 1216 includes a recess 1217. In some examples, the end beam 1204 includes three projections 1216. It is understood while the end beam 1204 is described having three projections 1216, any suitable number of projections is contemplated by the present disclosure.

Figure 16A:
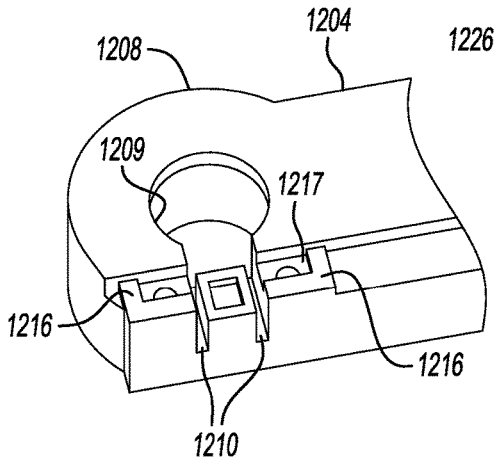
FIGS. 16A-16E illustrate another alternative shelf frame assembly system according to the principles of the present disclosure.
Figure 16B:
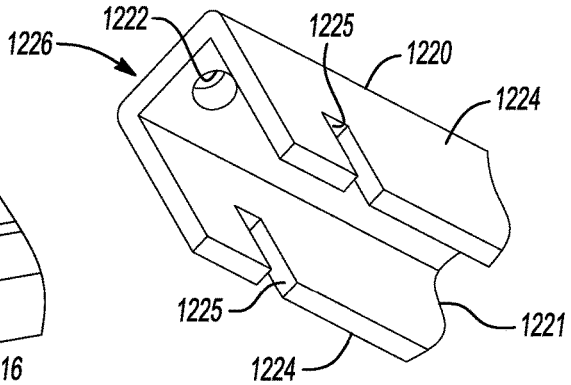
Figure 16C:
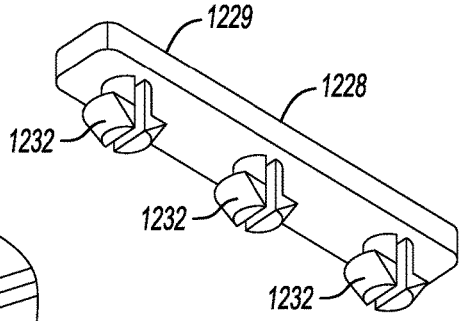

The grooves 1210 are configured to receive a portion of the side beam 1220. In one example, the end beam 1204 includes two grooves 1210. A first groove 1210 is disposed between a first projection 1216 and a second projection 1216 and a second groove 1210 is disposed between the second projection 1217 and a third projection 1216, as illustrated in FIG. 16A. The grooves 1210 may be thin gaps in the end beam 1204 that extend into the end beam 1204 away from the projections 1216.

Figure 16D:
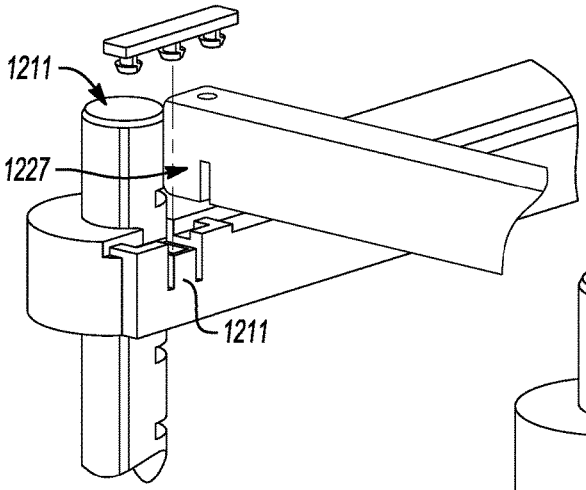
Figure 16E:
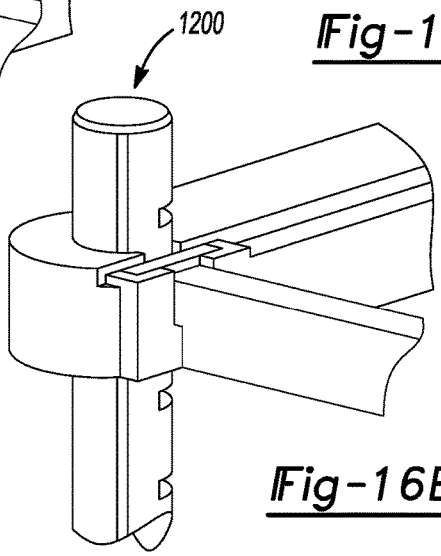

The side beam 1220 may include two sides 1224, a "C" shaped channel 1221, and a hole 1222 disposed on an upper portion of the side beam 1220. The channel 1221 is defined by the sides 1224. Each of the sides 1224 include a slot 1225 disposed near an end 1226 of the side beam 1220. The slots 1225 may comprise a thin opening that extends from a lower portion of each of the sides 1224 and toward the upper portion of the side beam 1220. The slots 1225 define a receiving portion 1227 as illustrated in FIG. 16D. The receiving portion includes a portion of the side beam 1220 disposed between the end 1226 and the slots 1225. The receiving portion 1227 includes the hole 1222 in the upper portion of the receiving portion 1227.

In one example, the receiving portion 1227 is configured to receive one of the projections 1216. For example, the assembler presses the side beam 1220 onto the coupling portion 1208 near the projections 1216. The grooves 1210 are configured to receive the portion of the side beam 1220 disposed between the end 1226 and the slots 1225. The receiving portion 1227 is configured to receive the projection 1216 defined by the grooves 1210. In this manner, the side beam 1220, when pressed into the coupling portion 1208, lays flush with respect to the projections 1216.

The cap 1228 includes an upper portion 1229 that includes one or more barbed projections 1232. In one example, the upper portion 1229 includes three barbed projections 1232. In another example, the number of barbed projections 1232 is equal to the number of projections 1216. The projections 1216 are configured to receive the barbed projections 1232. For example, the each of recesses 1217 is configured to receive one of the one or more barbed projections 1232. Each of the barbed projections 1232 includes a barb and a shaft. The barb is configured to be pressed into one of the recesses 1217 and resist withdrawal from the recess 1217.

In one example, the hole 1222 is aligns with one of the projections 1216 when the side beam 1220 is pressed onto the coupling portion 1208. The hole 1222 is configured to allow one of the barbed projections 1232 to pass through the hole 1222 and to be received by one of the projections 1216. In this manner, the cap 1228 locks the side beam 1220 to the end beam 1204.

The foregoing description of the implementations has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example implementations are provided so that this disclosure will be thorough, and will fully convey the scope to those who are skilled in the art. Numerous specific details are set forth such as examples of specific components, devices, and methods, to provide a thorough understanding of implementations of the present disclosure. It will be apparent to those skilled in the art that specific details need not be employed, that example implementations may be embodied in many different forms and that neither should be construed to limit the scope of the disclosure. In some example implementations, well-known processes, well-known device structures, and well-known technologies are not described in detail.

What is claimed is:

1. A shelf frame assembly system comprising:

a post extending in a vertical direction and comprising a first side surface, a second side surface and plurality of vertically-spaced openings disposed through the post and extending from the first side surface to the second side surface;

a tubular side beam extending longitudinally in a horizontal direction and comprising a receiving bore disposed at a first end of the side beam;

an end piece comprising a coupling portion and a receiving portion, the coupling portion being received in the receiving bore of the side beam and joining the end piece to the side beam, the receiving portion comprising an open end having two parallel, spaced-apart, opposing, vertical side walls and a horizontal top wall connecting to each side wall at a respective upper end thereof, each vertical side wall comprising at least one protrusion extending along the vertical direction and protruding outwardly from an inner surface of the respective side wall in the horizontal direction toward the opposing side wall of the two side walls; and an end connector extending in the horizontal direction and comprising an annular stop portion located around a perimeter of the end connector and separating the end connector into a first body portion located on a first side of the stop portion and a second body portion located on a second side of the stop portion, each of the first body portion and the second body portion comprising two parallel, spaced apart, opposing vertical sides, each side comprising at least one recess extending along the vertical direction and receding inwardly from an outer surface of the respective side in the horizontal direction toward the opposing side of the two sides;

wherein the end connector is inserted through a selected opening of the plurality of openings such that the first body portion extends outwardly from the first side surface of the post, the second body portion extends outwardly from the second side surface of the post and the stop portion abuts the second side surface of the first post around a perimeter of the selected opening; and wherein the open end of the end piece is joined to the first body portion of the end connector by the at least one protrusion of each of the two side walls of the end piece being received, respectively, in the at least one recess of each of the two opposing sides of the first body portion so as to resist a horizontal withdrawal of the end piece from the end connector.

2. The shelf frame assembly system of claim 1, wherein each of the plurality of openings comprises a closed perimeter.

3. The shelf frame assembly system of claim 1, wherein the end connector is symmetrical about the stop portion.

4. The shelf frame assembly system of claim 1, further comprising a second post extending in the vertical direction and spaced apart from the post in a horizontal direction; and a post connector connecting the post to the second post;

wherein said post connector extends perpendicularly to the side beam.

5. The shelf frame assembly system of claim 4, further comprising two post connectors connecting the post to the second post;

wherein a first post connector connects the post to the second post at respective upper ends of each of the post and the second post; and wherein a second post connector connects the post to the second post at respective lower ends of the post and the second post.

6. The shelf frame assembly system of claim 5, further comprising a plurality of tubular side beams;

wherein each of the post connectors further comprises a side beam receiving portion; and wherein at least one of the plurality of side beams is received in the side beam receiving portion of one of the two post connectors.

7. The shelf frame assembly system of claim 1, further comprising a second tubular side beam extending in a horizontal direction and comprising a second receiving bore disposed at a first end of the second side beam;

a second end piece comprising a second coupling portion and a second receiving portion, the second coupling portion being received in the second receiving bore of the second side beam and joining the second end piece to the second side beam, the second receiving portion comprising a second open end having two parallel, spaced-apart, opposing, vertical second side walls and a second horizontal top wall connecting to each second side wall at a respective second upper end thereof, each second vertical side wall comprising at least one second protrusion extending along the vertical direction and protruding outwardly from a second inner surface of the respective second side wall in the horizontal direction toward the opposing second side wall of the two second side walls; and wherein the second open end of the second end piece is joined to the second body portion of the end connector by the at least one second protrusion of each of the two second side walls of the second end piece being received, respectively, in the at least one recess of each of the two opposing sides of the second body portion so as to resist a horizontal withdrawal of the second end piece from the end connector.

8. The shelf frame assembly system of claim 7, wherein each of the plurality of openings comprises a closed perimeter.

9. The shelf frame assembly system of claim 7, wherein the end connector is symmetrical about the stop portion.

10. The shelf frame assembly system of claim 7, further comprising a second post extending in the vertical direction and spaced apart from the post in a horizontal direction; and a post connector connecting the post to the second post;

wherein said post connector extends perpendicularly to the side beam.

11. The shelf frame assembly system of claim 10, further comprising two post connectors connecting the post to the second post;

wherein a first post connector connects the post to the second post at respective upper ends of each of the post and the second post; and wherein a second post connector connects the post to the second post at respective lower ends of the post and the second post.

12. The shelf frame assembly system of claim 11, further comprising a plurality of tubular side beams;

wherein the first post connector further comprises a first side beam receiving portion and the second post connector comprises a second side beam receiving portion;

wherein at least one of the plurality of side beams is received in one of the first side beam receiving portion and the second side beam receiving portion.

13. The shelf frame assembly system of claim 1, further comprising:

a second post, a third post and a fourth post, each extending in the vertical direction;

a plurality of post connectors, each of the plurality of post connectors comprising at least one side beam receiving portion; and a plurality of tubular side beams, each extending longitudinally in the horizontal direction and comprising a first end and a second end;

wherein a first post connector of the plurality of post connectors connects the post to the second post and a second post connector of the plurality of post connectors connects the third post to the fourth post; and wherein a first end of a first side beam of the plurality of side beams is received in the side beam receiving portion of the first post connector and a second end of the first side beam is received in the side beam receiving portion of the second post connector.

14. The shelf frame assembly system of claim 13, wherein a second side beam of the plurality of side beams comprises a second receiving bore disposed at a first end of the second side beam; and wherein the shelf frame assembly system further comprises a second end piece comprising a second coupling portion and a second receiving portion, the second coupling portion being received in the second receiving bore of the second side beam and joining the second end piece to the second side beam, the second receiving portion comprising a second open end having two parallel, spaced-apart, opposing, vertical second side walls and a second horizontal top wall connecting to each second side wall at a respective second upper end thereof, each second vertical side wall comprising at least one second protrusion extending along the vertical direction and protruding outwardly from a second inner surface of the respective second side wall in the horizontal direction toward the opposing second side wall of the two second side walls; and wherein the second open end of the second end piece is joined to the second body portion of the end connector by the at least one second protrusion of each of the two second side walls of the second end piece being received, respectively, in the at least one recess of each of the two opposing sides of the second body portion so as to resist a horizontal withdrawal of the second end piece from the end connector.

* * * * *